US006105520A

United States Patent [19]

Frazer et al.

[11] Patent Number: 6,105,520

[45] Date of Patent: Aug. 22, 2000

[54] QUILT MAKING AUTOMATIC SCHEDULING SYSTEM AND METHOD

[75] Inventors: James T. Frazer, Tamarac, Fla.; Von Hall, Jr., Mt. Juliet, Tenn.; M. Burl White, Coral Springs, Fla.

[73] Assignee: L&P Property Management Company, South Gate, Calif.

[21] Appl. No.: 09/301,653

[22] Filed: Apr. 28, 1999

Related U.S. Application Data

[60] Provisional application No. 60/122,749, Feb. 26, 1999.

[51] Int. Cl.[7] ..... D05B 11/00; D05B 19/00

[52] U.S. Cl. ..... 112/117; 112/155; 112/475.08; 364/470.09

[58] Field of Search ..... 112/117, 118, 112/119, 470.01, 470.06, 475.08, 155, 163, 167, 475.05, 102.5; 364/470.07, 470.09

[56] References Cited

U.S. PATENT DOCUMENTS

| | | | |
|---|---|---|---|
| 5,603,270 | 2/1997 | White et al. | 112/117 |
| 5,921,194 | 7/1999 | Komuro et al. | 112/470.01 |
| 5,954,005 | 9/1999 | Sekine et al. | 112/470.04 |

*Primary Examiner*—Peter Nerbun

*Attorney, Agent, or Firm*—Wood, Herron & Evans, L.L.P.

[57] ABSTRACT

A quilt manufacturing facility having a plurality of quilting machines is provided with an automated scheduling system which automatically generates and distributes schedules for the making of quilted products listed in input customer orders. The generated schedules are distributed in the form of computer files downloaded to the controllers of the machines. The generation of schedules is carried out by a programmed central scheduling computer which considers stored data identifying each of the machines and their capabilities, the materials available for production of the products and the product specifications, and determines the machine setting and material requirements for each product on the customer order list as well as the required completion times for each of the ordered products. Schedules for each machine are generated so as to schedule each product with other products having similar machine setting or material requirements in a manner that is consistent with the required completion or delivery times for each product. The scheduling optimizes the use of the quilting machines and operator time by reducing the number of machine setups and material changes. Information is collected from each machine which records all downtime of the machines and the reasons therefor and which records a history of the actual performance of the machines for use by the scheduling computer in more accurately evaluating future schedules.

19 Claims, 25 Drawing Sheets

PRODUCTS FILE MAINTENANCE

PRODUCT ID [C009P34TWRP) DESCRIPTION QLT. RESTOPEDIC PANEL 3/3

PATTERN 206-RR.BB LENGTH 12.00 WIDTH 7.00 UNITS E TYPE C

STITCH DENSITY 7.00 NEEDLE SETTING 28 PATTERN CLASS 1

FEED COMPENSATION .000 CARRIAGE COMPENSATION .000 MACHINE SPEED 1000

TACK-AND JUMP INFORMATION

FEED JUMP CARRIAGE JUMP TOIL LENGTH TACKS

TOP MATERIAL CONNIE BACKING MATERIAL LIGHT DFT. MACH. 4300

FILL #1 3/8 FILL#2 3/8 FILL#3 FILL#4

PANEL LENGTH 38.30 PANEL WIDTH 75.50 AVG R/TIME .00 PANEL/WINDUP W

COMPANY-1 INQUIRY VERIFY

FIG. 4A

QUILTING MACHINE MAINTENANCE

MACHINE ID [2300] COPY FROM

DESCRIPTION 2300 QUILTING MACHINE

TOP MACHINE SPEED 1500
CARRIAGE TRAVEL 12.50
AUTOMATED MACHINE YES
AVG THROUGHOUT PER HR 100.00
MACHINE CLASS 2

COMPANY-1 INQUIRY VERIFY

< MACHINE INQUIRY >

| MACHINE | DESCRIPTION | CLASS |
|---|---|---|
| <begin> | | |
| 1300 | 1300 QUILTING MACHINE | 1 |
| 2300 | 2300 QUILTING MACHINE | 2 |
| 4300 | 4300 QUILTING MACHINE | 4 |
| <end> | | |

FIG. 4B

STOP CODE MAINTENANCE

STOP CODE [10] COPY FROM

DESCRIPTION BREAK TIME

COMPANY-1 INQUIRY VERIFY

STOP CODE INQUIRY

| CODE | DESCRIPTION |
|---|---|
| <begin> | |
| 10 | BREAK TIME |
| 20 | GENERAL MAINTENANCE |
| 21 | LOOPER MAINTENANCE |
| 22 | NEEDLE MAINTENANCE |
| 23 | MACHINE JAM |
| 24 | CUTTER MAINTENANCE |
| 30 | MEAL TIME |
| 40 | MEETINGS |
| 50 | OUT OF WORK |
| 60 | OUT OF MATERIAL |
| 70 | MATERIAL UNLOADING |
| 99 | MISCELLANEOUS |
| <end> | |

FIG. 4C

SHAPE FILE MAINTENANCE

PATTERN ID [206.BB] COPY FROM
DESCRIPTION 206 PATTERN
TYPE C
PATTERN CLASS 1

COMPANY-1 INQUIRY VERIFY

SHAPE FILE INQUIRY

| PATTERN ID | DESCRIPTION | TYPE | CLASS |
|---|---|---|---|
| <begin> | | | |
| 1-2CIRC.BB | 1-2 CIRCLE PATTERN | C | |
| 206-RR.BB | 206-RR PATTERN | C | |
| 206.BB | 206 PATTERN | C | |
| 301.BB | 301 PATTERN | C | 1 |
| 309.BB | 309 PATTERN | C | 1 |
| 340.BB | 340 PATTERN | C | 1 |
| CIRCL720.BB | CIRCLE 720 PATTERN | T | 4 |
| CLOUD-E.BB | CLOUD PATTERN | C | 2 |
| DIA.BB | DIAMOND PATTERN | C | 2 |
| SWIRL.BB | SWIRL PATTERN | T | |
| SHELL-E.BB | SHELL PATTERN | C | 2 |
| <end> | | | |

FIG. 4D

TOP GOOD MATERIAL MAINTENANCE

TOP GOOD ID [APPLE] COPY FROM

DESCRIPTION APPLE PATCH WHITE [88"]

COMPANY-1 INQUIRY VERIFY

< TOP GOODS INQUIRY >

| PATTERN ID | DESCRIPTION |
|---|---|
| <begin> | |
| APPLE | APPLE PATCH WHITE [88"] |
| BEIGE | CHAGOL NATURAL [88"] |
| COCO | COCORAN POWDER [88"] |
| CONNIE | '24' BALSAM NATURAL [84"] |
| HEAVEN | SKY/NAT 6J01 [91"] |
| KAITLIN | PASTEL [88"] |
| MUSIC | VANILLA/HONEY 6C26 [84"] |
| NYMPH | 88 NYMPH WEDGEWOOD P82000 |
| PEARL | PEARL SKY [88"] |
| SOUTHPORK | ANNIVERSARY F/C |
| VENUS | T-405 #10428056 NIAGA [82"] |
| <end> | |

FIG. 4E

BACKING MATERIAL MAINTENANCE

BACKING ID [HEAVY] COPY FROM

DESCRIPTION HEAVY BACKING

COMPANY-1 INQUIRY VERIFY

< BACKING MATERIAL INQUIRY >

| ITEM ID | DESCRIPTION |
|---|---|
| <begin> | |
| HEAVY | HEAVY BACKING |
| LIGHT | LIGHT BACKING |
| <end> | |

FIG. 4F

FILL COMBO MATERIAL MAINTENANCE

FILL COMBO [037 036] COPY FROM

DESCRIPTION 3/8 12036 POLY

COMPANY-1 INQUIRY VERIFY

< FILL COMBO INQUIRY >

| ITEM ID | DESCRIPTION |
|---|---|
| <begin> | |
| 019 036 | 3/16 12036 POLY |
| 037 015 | 3/8 15024 POLY |
| 037 024 | 3/8 15024 POLY |
| 037 036 | 3/8 12036 POLY |
| 050 015 | 1/2 15015 POLY |
| 050 017 | 1/2 11017 POLY |
| 050 024 | 1/2 15024 POLY |
| 050 036 | 1/2 12036 POLY |
| WOOL | WOOL |
| <end> | |

FIG. 4G

IMPORT ITEMS FROM QUILTING MACHINE

MACHINE [1300]

APPEND/MODIFY A
IMPORT/EXPORT M

COMPANY-1 INQUIRY VERIFY

FIG. 4H

DOWNLOAD PRODUCTION

HAVE YOU DONE THE FOLLWING?[NO]

-REACHED A STOPPING POINT ON THE MACHINES.
-BACKED UP THE SYSTEM.

MUST ENTER Y OR N.

COMPANY-1 VERIFY

FIG. 4I

POST PRODUCTION

HAVE YOU DONE THE FOLLWING?[NO]

-PRINTED THE DAILY PRODUCTION REPORT.
-BACKED UP THE SYSTEM.

COMPANY-1 VERIFY

FIG. 4K

JOB INFO

SCHEDULED DATE [00/00/19??]
SCHEDULED SHIFT
SCHEDULED CODE
ITEM
DESCRIPTION

SCHEDULE INFO

ORDER NUMBER
RUN PRIORITY 0
RUN # 000
ROUTE SEQ# 000
JOB TYPE

AMOUNT .00

COMPANY-1 VERIFY

FIG. 4L

PRINT·PRODUCTION REPORT

PRODUCTION DATE FROM [00/00/0000]
PRODUCTION DATE THRU

COMPANY-1 VERIFY

04/22/1998 MATTRESS PRODUCERS, INC. PAGE 1
QUILT PANELS DAILY PRODUCTION REPORT

| ITEM ID | DESCRIPTION | QUANTITY PRODUCED |
|---|---|---|
| QCUML397410000 | QLT. ULTRA CLOUD 3/3 | 41 |
| QCUML608010000 | HOTEL ULTRA CLOUD 3/0 | 7 |
| QCUML768010000 | HOTEL ULTRA CLOUD 6/6 | 17 |
| QDREE397405600 | DREAMLINER 3/3 ELAINE | 170 |
| QDREE547405600 | DREAMLINER 4/6 ELAINE | 148 |
| QDREE608005600 | DREAMLINER 60x80 ELAINE | 59 |
| QDREE768005600 | DREAMLINER 76x80 ELAINE | 10 |
| QGKGD397410000 | QLT. DAKOTA 3/3 | 11 |
| QGKGD398010000 | QLT. DAKOTA 3/3x80 | 32 |
| QGKGD547410000 | QLT. DAKOTA 4/6 | 29 |
| QGKGD808010000 | DAKOTA 5/0 | 17 |
| QGKGD768010000 | QLT. DAKOTA 6/6 | 13 |
| QMCJR608005600 | QLT. MEDOPEDIC PANEL 5/0 | 22 |
| QMKJR397407500 | QLT. M/KNIGNY PANEL 3/3 | 12 |
| QMKJR608007500 | QLT. M/KNIGNY PANEL 5/0/ | 21 |
| QMRSD768007500 | QLT. HOTEL MASTER REST 6/6 | 35 |
| QNFIE5474100000 | NOBIL. U/FIRM 54/74 PANEL | 108 |
| QNFIE6080100000 | NOBIL. U/FIRM 60/80 PANEL | 84 |
| QNFIE7680100000 | NOBIL. U/FIRM 6/6 PANEL | 15 |
| QRCBA5474 5000 | QLT. ROYAL CLOUD 4/6 | 10 |
| QRCBA548005000 | HOTEL ROYAL CLOUD 4/6x80 | 307 |
| QRCBA608005000 | HOTEL ROYAL CLOUD 5/0 | 134 |
| QRCBA768005000 | HOTEL ROYAL CLOUD 6/8 | 50 |
| TOTAL QUANTITY PRODUCED FOR DATE/SHIFT | | 5690 |

TOTAL QUANTITY PRODUCED 5690 4086 (YARDS)

*END OF REPORT*

FIG. 4J

SCHEDULE·ASSIGNMENT

SCHEDULE CRITERIA

SCHEDULED FROM DATE [00/00/0000]
SCHEDULED FROM SHIFT

SCHEDULED THRU DATE
SCHEDULED THRU SHIFT

COMPANY-1 VERIFY

FIG. 4M

EDIT·MACHINES JOBS

MACHINE: 4300 VIEW: ITEM

| SEQ | | ITEM-ID | DESCRIPTION | QTY. | ORDER |
|---|---|---|---|---|---|
| 0001 | 0 | ODYMS547405005 | DREAMAWAY 4/6 MO. SEA PANEL | 16 .00 | |
| 0002 | | ODYMS547405005 | DREAMAWAY 4/6 MO. SEA PANEL | 2.00 | |
| 0003 | | QALFC547405005 | ANNIVERSARY 4/6 WAYNE | 2.00 | |
| 0004 | | QSDCN547410005 | SOUTHERN DREAMS 4/6 | 12.00 | |
| 0005 | | QSDCN547410005 | SOUTHERN DREAMS 4/6 | 4.00 | |
| 0006 | | QSDCN547410005 | SOUTHERN DREAMS 4/6 | 4.00 | |
| 0007 | | [illegible] | SOUTHERN DREAMS 4/6 P/TOP | 4.00 | |
| 0008 | | [illegible] | SOUTHERN DREAMS 5/0 | 4.00 | |
| 0009 | | [illegible] | SOUTHERN DREAMS 5.0 P/TOP | 2.00 | |
| 0010 | | QSDCN547410005P | SOUTHERN DREAMS 4/6 P/TOP | 4.00 | |
| 0011 | | QSDCN547410005P | SOUTHERN DREAMS 5/0 P/TOP | 2.00 | |

CURSOR 102 101

(SEQ 1 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY

FIG. 4O

EDIT·MACHINES JOBS

MACHINE: 4300 VIEW: FILL COMBOS

| SEQ | | NEEDLES | TOP GOOD | FILL 1 | FILL 2 | FILL 3 | BACKING | QTY. | ORDER |
|---|---|---|---|---|---|---|---|---|---|
| 0001 | 0 | 14 | MO. SEA | 050 036 | .5 DAC | | HEAVY | 16.00 | |
| 0002 | | 14 | MO. SEA | 050 036 | .5 DAC | | HEAVY | 2.00 | |
| 0003 | | 14 | WAYNE | 050 036 | .5 DAC | | HEAVY | 2.00 | |
| 0004 | | 14 | COCO | 050 036 | 050 036 | 6.5 DAC | HEAVY | 12.00 | |
| 0005 | | 14 | COCO | 050 036 | 050 036 | 6.5 DAC | HEAVY | 4.00 | |
| 0006 | | 14 | COCO | 050 036 | 050 036 | 6.5 DAC | HEAVY | 4.00 | |
| 0007 | | 14 | COCO | 050 036 | 050 036 | 6.5 DAC | HEAVY | 4.00 | |
| 0008 | | 14 | COCO | 050 036 | 050 036 | 6.5 DAC | HEAVY | 4.00 | |
| 0009 | | 14 | COCO | 050 036 | 050 036 | 6.5 DAC | HEAVY | 2.00 | |
| 0010 | | 14 | COCO | 050 036 | 050 036 | 6.5 DAC | HEAVY | 4.00 | |
| 0011 | | 14 | COCO | 050 036 | 050 036 | 6.5 DAC | HEAVY | 2.00 | |

103

(SEQ 1 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY

FIG. 4P

04/08/1998 MATTRESS PRODUCERS, INC. PAGE 1
QUILT PANELS DAILY PRODUCTION REPORT

MACHINE: 2300 QUILTING MACHINE
MACHINE CAPACITY: 100.00
MACHINE YARDAGE: 549.55 *OVERLOADED*
MACHINE CLASS: 2

MACHINE SET POINT:

| PRODUCT | DESCRIPTION | QTY | NEEDLES | TOP GOODS | FILL 1 | FILL 2 | FILL 3 | FILL 4 | PATTERN | DATE REQ |
|---|---|---|---|---|---|---|---|---|---|---|
| QRCCE397407500 | RESTOPEDIC 3/3 | | 28 | CONNIE | 037 036 | 037 036 | | | 206-RR.BB | 06/24/1998 |
| QRCCE547407500 | RESTOPEDIC 4/6 | 48.00 | 28 | CONNIE | 037 036 | 037 036 | | | 206-RR.BB | 06/25/1998 |
| QRCCE397407500 | RESTOPEDIC 3/3 | 34.00 | 28 | CONNIE | 037 036 | 037 036 | | | 206-RR.BB | 06/25/1998 |
| QRCCE547407500 | RESTOPEDIC 4/6 | 26.00 | 28 | CONNIE | 037 036 | 037 036 | | | 206-RR.BB | 06/25/1998 |
| QRCCE608007500 | RESTOPEDIC 5/O | 5.00 | 28 | CONNIE | 037 036 | 037 036 | | | 206-RR.BB | 06/25/1998 |
| QRCCE768007500 | QLT. RESTOPEDIC PANEL | 2.00 | 28 | CONNIE | 037 036 | 037 036 | | | 206-RR.BB | 06/25/1998 |
| QRCCE397407500 | RESTOPEDIC 3/3 | 44.00 | 28 | CONNIE | 037 036 | 037 036 | | | 206-RR.BB | 06/26/1998 |
| QRCCE768007500 | QLT. RESTOPEDIC PANEL | 4.00 | 28 | CONNIE | 037 036 | 037 036 | | | 206-RR.BB | 07/10/1998 |
| QMKJR379407500 | QLT. M/KNIGNY PANEL 3 | 4.0 | 28 | JEBBER | 037 036 | 037 036 | | | 206.BB | 07/07/1998 |
| QMKJR547407500 | QLT. M/KNIGNY PANEL 4 | 4.0 | 28 | JEBBER | 037 036 | 037 036 | | | 206.BB | 07/07/1998 |
| QABLY398007500 | QLT. ADJ/BED PANEL 3/ | 4.00 | 28 | LALLY | 037 036 | 037 036 | | | 340.BB | 06/15/1998 |
| QESVS547401900 | QLT. EASY SLEEP PANBE | 8.00 | 28 | VENUS | 019 036 | | | | 206-RR.BB | 07/07/1998 |
| QESVS547401900 | QLT. EASY SLEEP PANBE | 30.00 | 28 | VENUS | 019 036 | | | | 206-RR.BB | 07/08/1998 |
| QESVS547401900 | QLT. EASY SLEEP PANBE | 6.00 | 28 | VENUS | 019 036 | | | | 206-RR.BB | 07/09/1998 |
| QESVS547401900 | QLT. EASY SLEEP PANBE | 14.00 | 28 | VENUS | 019 036 | | | | 206-RR.BB | 07/10/1998 |
| QESVS397401900 | QLT. EASY SLEEP PANBE | 70.00 | 28 | VENUS | 019 036 | | | | 206-RR,BB | 06/25/1998 |
| QDREE397405600 | DREAMLINER 3/3 ELAINE | 8.00 | 28 | ELAINE | 037 036 | 019 036 | | | 340.BB | 06/19/1998 |
| QDREE547405600 | DREAMLINER 4/6 ELAINE | 2.00 | 28 | ELAINE | 037 036 | 019 036 | | | 340.BB | 06/19/1998 |

---TOTAL YARDS---
549.55

----MATERIAL REQUIREMENTS----

| | | |
|---|---|---|
| 2300 | 019 036 | 549.55 |
| 2300 | 037 036 | 122.00 |
| 2300 | 050 024 | 78.00 |
| 2300 | 050 038 | 50.00 |
| 2300 | CONNIE | 287.00 |
| 2300 | ELAINE | 7.50 |
| 2300 | JEBBER | 14.00 |
| 2300 | LALLY | 7.00 |
| 2300 | VENUS | 234.05 |

*END OF REPORT*

THE REPORT TALLIES THE TOTAL YARDAGE OF QUILTING THIS SCHEDULE WILL PRODUCE.

AND IT PROVIDES TOTALS FOR ALL TOP GOODS AND FILL MATERIALS THAT WILL BE USED IN PRODUCING THE SCHEDULED ITEMS.

FIG. 4N

EDIT·MACHINES JOBS

MACHINE: 4300 VIEW: ITEM

| SEQ | ITEM-ID | DESCRIPTION | QTY. | ORDER |
|---|---|---|---|---|
| 0001 0 | ODYMS547405005 | DREAMAWAY 4/6 MO. SEA PANEL | 16.00 | 3 |
| 0002 | ODYMS547405005 | DREAMAWAY 4/6 MO. SEA PANEL | 2.00 | |
| 0003 | QALFC547405005 | ANNIVERSARY 4/6 WAYNE | 2.00 | |
| 0004 | QSDCN547410005 | SOUTHERN DREAMS 4/6 | 12.00 | 1 |
| 0005 | QSDCN547410005 | SOUTHERN DREAMS 4/6 | 4.00 | |
| 0006 | QSDCN547410005 | SOUTHERN DREAMS 4/6 | 4.00 | 2 |
| 0007 | QSDCN547410005P | SOUTHERN DREAMS 4/6 P/TOP | 4.00 | |
| 0008 | QSDCN608010005 | SOUTHERN DREAMS 5/0 | 4.00 | |
| 0009 | QSDCN608010005P | SOUTHERN DREAMS 5.0 P/TOP | 2.00 | |
| 0010 | QSDCN547410005P | SOUTHERN DREAMS 4/6 P/TOP | 4.00 | |
| 0011 | QSDCN547410005P | SOUTHERN DREAMS 5/0 P/TOP | 2.00 | |

(SEQ 1 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY

108

106, 107

FIG. 4S

EDIT·MACHINES JOBS

MACHINE: 4300 VIEW: ITEM

| SEQ | ITEM-ID | DESCRIPTION | QTY. | ORDER |
|---|---|---|---|---|
| 0001 0 | ODYMS547405005 | DREAMAWAY 4/6 MO. SEA PANEL | 16.00 | 3 |
| 0002 | ODYMS547405005 | DREAMAWAY 4/6 MO. SEA PANEL | 2.00 | |
| 0003 | QALFC547405005 | ANNIVERSARY 4/6 WAYNE | 2.00 | |
| 0004 | QSDCN547410005 | SOUTHERN DREAMS 4/6 | 12.00 | 1 |
| 0005 | QSDCN547410005 | SOUTHERN DREAMS 4/6 | 4.00 | |
| 0006 | QSDCN547410005 | SOUTHERN DREAMS 4/6 | 4.00 | 2 |
| 0007 | QSDCN547410005P | SOUTHERN DREAMS 4/6 P/TOP | 4.00 | |
| 0008 | QSDCN608010005 | SOUTHERN DREAMS 5/0 | 4.00 | |
| 0009 | QSDCN608010005P | SOUTHERN DREAMS 5.0 P/TOP | 2.00 | |
| 0010 | QSDCN547410005P | SOUTHERN DREAMS 4/6 P/TOP | 4.00 | |
| 0011 | QSDCN547410005P | SOUTHERN DREAMS 5/0 P/TOP | 2.00 | |

(SEQ 9 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY

110

109

FIG. 4T

EDIT·MACHINES JOBS

MACHINE: 4300 VIEW: ITEM

| SEQ | | ITEM-ID | DESCRIPTION | QTY. | ORDER |
|---|---|---|---|---|---|
| 0001 | O | ODYMS547405005 | DREAMAWAY 4/6 MO. SEA PANEL | 16 .00 | |
| 0002 | | ODYMS547[illegible] | DREAMAWAY 4/6 MO. SEA PANEL | 2.00 | |
| 0003 | | QALF[illegible] | [illegible]NIVERSARY 4/6 WAYNE | 2.00 | |
| 0004 | | QSDC[illegible] | [illegible]UTHERN DREAMS 4/6 | 12.00 | |
| 0005 | | QSDCN547[illegible] | SOUTHERN DREAMS 4/6 | 4.00 | |
| 0006 | | QSDCN547410005 | SOUTHERN DREAMS 4/6 | 4.00 | |
| 0007 | | QSDCN547410005P | SOUTHERN DREAMS 4/6 P/TOP | 4.00 | |
| 0008 | | QSDCN608010005 | SOUTHERN DREAMS 5/0 | 4.00 | |
| 0009 | | QSDCN608010005P | SOUTHERN DREAMS 5.0 P/TOP | 2.00 | |
| 0010 | | QSDCN547410005P | SOUTHERN DREAMS 4/6 P/TOP | 4.00 | |
| 0011 | | QSDCN547410005P | SOUTHERN DREAMS 5/0 P/TOP | 2.00 | |

CURSOR

112

(SEQ 8 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY

111

FIG. 4U

EDIT·MACHINES JOBS

MACHINE: 4300 VIEW: ITEM

| SEQ | | ITEM-ID | DESCRIPTION | QTY. | ORDER |
|---|---|---|---|---|---|
| 0001 | O | ODYMS547405005 | DREAMAWAY 4 | | |
| 0002 | | ODYMS547405005 | DREAMAWAY 4 | | |
| 0003 | | QALFC547405005 | ANNIVERSARY | | |
| 0004 | | QSDCN547410005 | SOUTHERN DRE | | |
| 0005 | | QSDCN547410005 | SOUTHERN DRE, | | |
| 0006 | | QSDCN547410005 | SOUTHERN DREAMS 4/6 | 4.00 | |
| 0007 | | QSDCN547410005P | SOUTHERN DREAMS 4/6 P/TOP | 4.00 | |
| 0008 | | QSDCN608010005 | SOUTHERN DREAMS 5/0 | 4.00 | |
| 0009 | | QSDCN608010005P | SOUTHERN DREAMS 5.0 P/TOP | 2.00 | |
| 0010 | | QSDCN547410005P | SOUTHERN DREAMS 4/6 P/TOP | 4.00 | |
| 0011 | | QSDCN547410005P | SOUTHERN DREAMS 5/0 P/TOP | 2.00 | |

1. ORIGINAL SEQUENCE
2. USER DEFINED SEQ 1
3. USER DEFINED SEQ 2

114

(SEQ 1 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY

113

FIG. 4V

EDIT·MACHINES JOBS

MACHINE: 4300 VIEW: ITEM

| SEQ | | ITEM-ID | DESCRIPTION | QTY. | ORDER |
|---|---|---|---|---|---|
| 0001 | O | ODYMS547405005 | DREAMAWAY 4/6 MO. SEA PANEL | 16 .00 | |
| 0002 | | ODYMS547405005 | DREAMAWAY 4/6 MO. SEA PANEL | 2.00 | |
| 0003 | | QALFC547405005 | ANNIVERSARY 4/6 WAYNE | 2.00 | |
| 0004 | | QSDCN547410005 | SOUTHERN DREAMS 4/6 | 12.00 | |
| 0005 | | QSDCN547410005 | SOUTHERN DREAMS 4/6 | 4.00 | |
| 0006 | | QSDCN547410005 | SOUTHERN DREAMS 4/6 | 4.00 | |
| 0007 | | QSDCN547410005P | SOUTHERN DREAMS 4/6 P/TOP | 4.00 | |
| 0008 | | QSDCN608010005 | SOUTHERN DREAMS 5/0 | 4.00 | |
| 0009 | | QSDCN608010005P | SOUTHERN DREAMS 5.0 P/TOP | 2.00 | |
| 0010 | | QSDCN547410005P | SOUTHERN DREAMS 4/6 P/TOP | 4.00 | |
| 0011 | | QSDCN547410005P | SOUTHERN DREAMS 5/0 P/TOP | 2.00 | |

(SEQ 1 OF 24)

(SET) (CLEAR) (MOVE) (GOTO) (RESEQ) (SUBMIT) (VIEW) (ADD) (CLEAR POINT) (SET POINT)

SCHEDULE FILE EXIST FOR MACHINE IMPORT OR DELETE?

COMPANY-1 INQUIRY VERIFY 115, 116

FIG. 4W

QUILT MAKING AUTOMATIC SCHEDULING SYSTEM AND METHOD

This application claims priority to U.S. Provisional application Ser. No. 60/122,749, filed Feb. 26, 1999, hereby expressly incorporated herein by reference.

FIELD OF THE INVENTION

The present invention relates to quilt making, and particularly to the scheduling, management and evaluation of quilt production in quilt manufacturing facilities that employ a plurality of automatically controllable quilt making machines.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet having a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. Quilting is performed on the customary quilts or comforters and on the covers of mattresses, for example. In the stitching of quilts for these two applications, two different approaches are typically used. Both approaches use stitches that employ both a top and a bottom thread.

High volume products that employ quilting processes are made by bedding manufacturers and manufacturers of some other products. In the manufacture of mattresses, for example, covers that surround spring interior assemblies are formed of quilted fabrics. Such quilted mattress covers are often manufactured on high speed automated quilting machines of the multi-needle type, which employ arrays of needles above a needle plate below which are arranged corresponding arrays of cooperating stitching elements. Multi-needle quilting machines for mattress cover production are typically chain stitch machines which quilt multiple patterns simultaneously on web fed material using series of double lock chain stitches.

Multiple needle quilters of the type illustrated in U.S. Pat. Nos. 5,154,130 and 5,554,589, hereby expressly incorporated by reference herein, are customarily used for the stitching of such mattress covers on multi-layered web fed material. Such multi-needle quilters use an array of cooperating chain stitch sewing elements, one of which is a needle positioned above the material and another of which is a looper below the material opposite the material from the needle. The entire arrays of both needles and loopers are mechanically linked together to form the stitches while moving in unison in two dimensions relative to the material, parallel to the plane of the material in paths that corresponds to identical patterns of a pattern array. It is common that the material is what is moved to form the patterns while the stitching element arrays remain stationary relative to the frame of the machine.

Quilt manufacturers also employ single needle quilters of the type illustrated and described in U.S. Pat. Nos. 5,640,916 and 5,685,250, hereby expressly incorporated by reference herein. The single needle quilters are customarily used for the stitching of comforters and other preformed rectangular panels. Such single needle quilters typically use a pair of cooperating lock stitch sewing heads, one carrying a needle drive that is typically positioned above the fabric and one carrying a bobbin that is opposite the fabric from the needle, with both heads being mechanically linked to move together in two dimensions, relative to the panel, parallel to the plane of the panel. A common operation of this type of quilting apparatus includes the supporting of the panel of fabric on a longitudinally moveable shuttle with the sewing heads moveable transversely of the panel to provide two dimensional stitching capability of the pattern on the panel. With such single needle quilting machines, varied and complex patterns can be produced. Further, lock stitch machines produce patterns that are finished on both sides of the material, where chain stitched patterns have a finished appearance only on the needle side of the fabric.

In the operation and management of a quilt manufacturing facility, a number of lines of quilting machines are often present. In the bedding manufacturing industry, several multi-needle machines may be operated, including machines of different speeds and sizes. Further, machines of the same sizes may be differently set-up to make different bedding products, or may be loaded with different materials. The same facility may have on the premises single needle quilters to make specialty or more expensive products. Usually, bedding manufacturers produce products in response to special customer orders from bedding wholesalers or retailers. In any case, the efficient operation of the facility requires management of the various machine lines and the coordination and distribution of various work orders among the production equipment. The coordination of orders with promised delivery dates and with available machines, the handling of material and of products in the plant, and the scheduling of machine set-ups and maintenance all require facility management to optimize these functions and the plant efficiency and to minimize overall production cost.

In the prior art, a variety of methods are in use in factories in which quilts are produced. In even the more sophisticated prior art case, a factory might be provided with a central computer system that provides functions for customer order entry and the generation of production requirements by way of a management system. Such a plant may be provided with an automated batch mode multi-needle web-fed quilting machine such as described in U.S. Pat. No. 5,554,589 referred to above. In such a factory, orders are taken from customers and entered into the central computer system via a terminal. Delivery dates are determined either by customer requirements or by availability of manufacturing capacity.

In such prior art systems, a management computer might be provided which analyzes customer orders to determine what products need to be manufactured for a given day. The central computer system produces production requirement reports for various departments, including the quilting department. The production requirements report may be a printed report or might take the form of production tickets that are communicated to managers or operators.

In larger factories, a supervisor of the quilting department may review the production report and determine what products will be assigned to each machine, providing the machine operators with either a written schedule or with a group of production tickets. The operator determines how best to produce the quilted panels. In smaller factories the production report might be sent directly to the machine operators. The operators enter into the quilting machines the products from the list along with the quantities needed of each in the order that is manually chosen. Often the machine is stopped during schedule entry, awaiting material changes by the operator.

The inevitable schedule changes that occur during a typical manufacturing day may be handled manually or by producing a schedule change sheet from the central computer. Change orders are given to a supervisor or machine operator and incorporated into the schedules as the people involved see fit. Machine performance and actual production statistics are generated manually, often in the form of a handwritten report prepared by an operator. As a result, optimum operating efficiency is not achieved.

Accordingly, there is a need for an improved system and method of scheduling the operations in a quilt manufacturing facility.

SUMMARY OF THE INVENTION

A primary objective of the present invention is to provide a method and apparatus for automatically and more efficiently scheduling the manufacture of various quilted products among a plurality of quilting machines.

In accordance with principles of the present invention, a quilt manufacturing system is provided having a plurality of quilting machines, preferably at least a plurality of multi-needle web-fed quilting machines, each having a programmed controller operative to control the respective machines to produce quilted products on multi-layered material in accordance with product configuration data. A scheduling sub-system evaluates all orders and information required to produce the products ordered by customers and to download optimized production schedules to the machines for use in producing the products.

In accordance with preferred embodiments of the invention, product configuration data is provided which preferably includes the identification of a pattern to be quilted on the product as well as the material of which the product is to be made and the size of the quilted product. A scheduling sub-system is provided which is connected to the controllers of each of the quilting machines. A customer order input station is provided for receiving customer order data identifying quilted products to be manufactured for customers. Digital storage media is provided for access by the scheduling sub-system to retrieve data identifying each of the quilting machines and their features, identifying materials from which quilted products are made, and listing the features of each product identified in a customer order data. The scheduling sub-system includes a digital processor programmed to generate schedules for each of the machines and to download schedules to the controllers of each of the machines to cause the production of quilted products identified in the customer data in accordance with the material and product data provided in the databases. The processor is programmed to evaluate the material information, the product details, and the machine features and to determine the content of the generated schedules based on the evaluation.

The system preferably is operated by preloading machine data records identifying each of the machines of the plurality, material data records cataloging materials from which quilts are produced on the machines. Product data records specifying quilted products to be made on the machines from the materials and including material, size, pattern, and pattern data records in controllers at each of the machines having data therein effective to cause the operation of the machine to quilt a respectively defined pattern on a quilted product. Customer order data is input to the central computer of the scheduling sub-system and a list of all of the orders is assembled in the scheduling sub-system computer and evaluated. The orders are correlated with data in the stored data records and is organized so as to produce optimized schedules for each of the plurality of the machines. The optimized schedules are downloaded to each of the machines and the products are quilted. The optimization is carried out so as to optimize the distribution of work among the machines, and particularly to reduce the time that the machines are not producing products. The optimizing of the distribution of work among the machines is carried out so as to reduce the time that the required of human operators to operate the machines to produce the products, such as by minimizing needle setting and other machine parameter setting changes, and minimizing material changes. The optimization takes into account the requirements for the timely production of the products to meet customer orders and to reduce production costs of the products.

The system also records the history of the production of products on each machine when producing products according to the automatically generated schedules and uses this information to produce management reports. The history information is also considered by the system in generating future schedules. The capability is provided to run a computer simulation of the schedules so that a scheduling operator can determine if modification of the schedule is desirable. Information is communicated to the scheduling sub-system from the controllers of the machines regarding events that have occurred, including particularly the stoppages of the machines for setups, for maintenance and for other reasons. The information is used for producing reports and to improve the optimization of the system, including schedule generation and other management of the system.

In accordance with a preferred embodiment of the invention, a quilt manufacturing facility is provided with a plurality of quilting machines having controllers each connected with an automated scheduling system. The scheduling system automatically generates and distributes schedules for the manufacture by each of the machines of series of quilted products that have been entered from customer orders. The generated schedules are downloaded to the controllers of the machines. The generation of the schedules is carried by the scheduling system in a programmed central scheduling computer which has access to previously loaded databases identifying each of the machines and their capabilities, listing the materials available for production of the products, and defining each of the products and listing the product specifications. The computer of the scheduling system determines the machine settings and material requirements for each product on the customer order list, and considers the requirements to meed specified completion times for each of the ordered products. Schedules for each machine are generated so as to group products on machines and order the production of products on each machine to take advantage of product similarities, including common machine needle settings and other machine settings, common materials, and the general logistics of supplies and products in the facility. The schedules are optimized in such a way as to minimize total production time or maximize productivity. This includes the optimal use of operator time by minimizing human tasks such as material setups and material changes. Information is collected from each machine from which the central computer records and analyzes all downtime of the machines and the reasons therefore and which records a history of the actual performance of the machines for use by the scheduling computer in more accurately evaluating future schedules.

The invention provides overall improved efficiency in a quilting plant by increasing productivity, reducing the time and cost of product production, and eliminates many sources of errors and waste.

These and other objectives and advantages of the present invention will be more readily apparent from the following detailed description of the drawings of the preferred embodiment of the invention, in which:

DETAILED DESCRIPTION OF THE DRAWINGS

Figure 1:
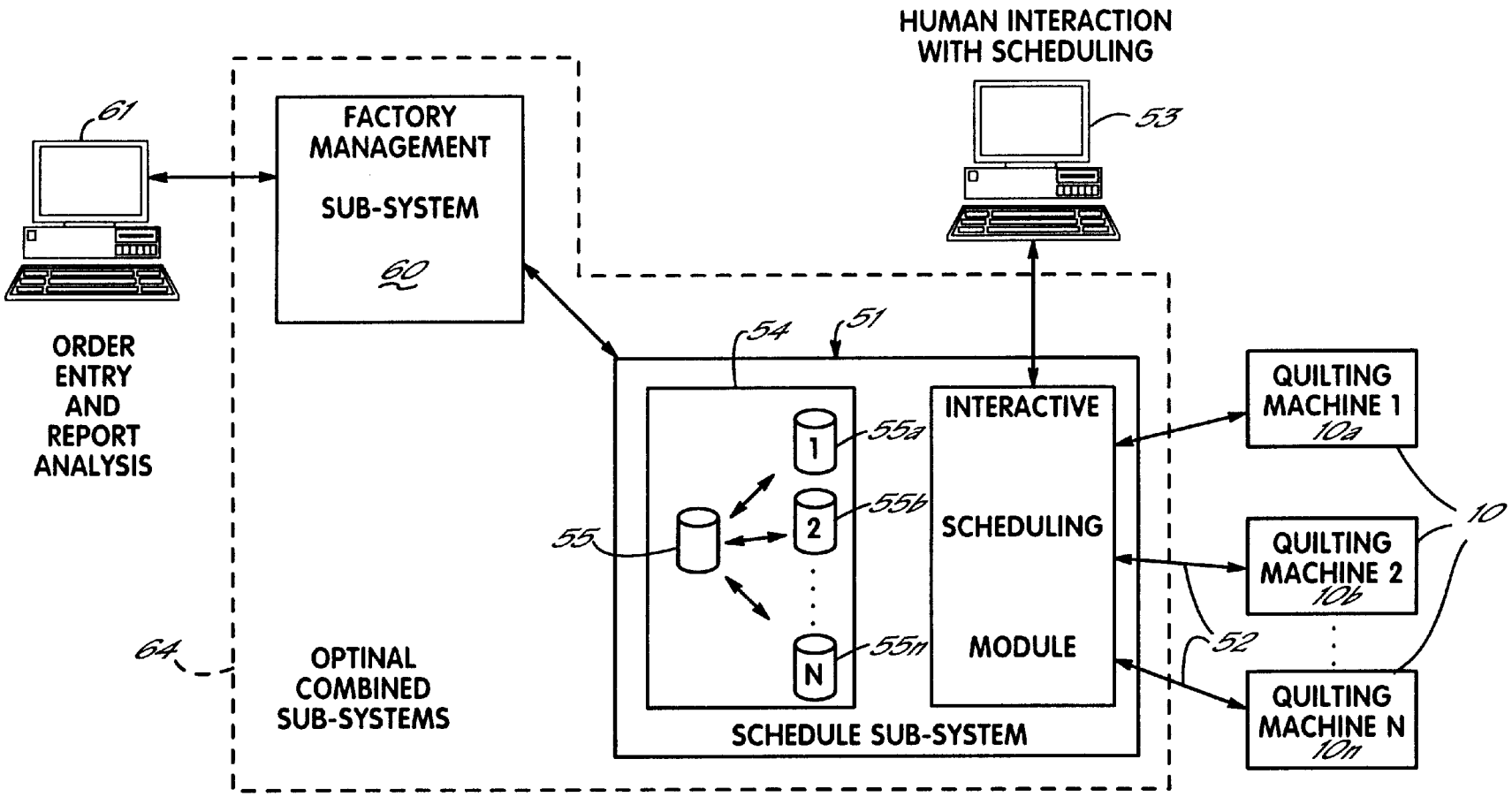
FIG. 1 is a block diagram representing a quilt manufacturing facility employing one preferred embodiment of an automatic scheduling system according to principles of the present invention.

FIG. 1 is a diagram of a factory 100 such as a bedding manufacturing facility that includes a plurality of quilting machines 10 which may be of various types 10*n*, but a plurality of which are preferably quilting machines 10*a*,10*b* of the multi-needle type having programmable controllers capable of automatically operating the machines to produce batches, or series of batches, of various products such as mattress covers of differing sizes and types. Quilting machines of this type include, for example, the Paragon 4 model machine manufactured by Gribetz International Corporation of Sunrise, Fla. Other quilting machines made by Gribetz and that may be among the machines 10 are models 4300, 4300e, 2300e and machines of having the Gribetz POINT & SEW™ feature. A quilting machine 10*a*, a plurality of which are included in the preferred embodiment of the invention, is diagrammatically illustrated in FIG. 2, and is described in more detail in U.S. Pat. No. 5,554,589 entitled Program Controlled Quilter and Panel Cutter System with Automatic Shrinkage Compensation, expressly incorporated herein by reference.

In accordance with the preferred embodiment of the invention, the each of the quilting machines 10 of the factory 100 is connected to a computer 51 of an automatic scheduling subsystem 50, preferably through Ethernet or other network connections 52. The scheduling system 50 includes scheduling terminal 53 through which a scheduling system operator can interact with the automatic scheduling features of the system 50 and modify schedules where necessary. The computer 51 includes a mass storage module 54 which contains a combined schedule database 55 and separate scheduling databases 55*a*, 55*b*, . . . 55*n*, one for each of the quilting machines 10*a*, 10*b*, . . . , 10*n* and containing the scheduling information for each respective machine 10. The remaining components of the scheduling computer 51 are represented as interactive scheduling module 56, which contains the processor (not shown) and the hardware and software for calculating and coordinating the schedules of each of the machines and communicating with the machines and the scheduling system operator.

The scheduling subsystem 50 is connected to a factory management system 60 which may process information regarding the activities of not only the quilting operations but other operations within the factory 100. Such a management system 60 is, for example, the JETSTREAM PCS system manufactured by Cybertek Systems of Nashville, Tenn. The scheduling system may be a computer that is separate from the management system 60, or may be included in a single computer 64 with the management system 60. The system 60 is connected to an order entry and report output terminal 61. Customer order entry information is input through the terminal 61 to the management system 60 which generates production requirements for the various departments and routes the quilting portions of the orders to the scheduling system 50. The production requirements are submitted in electronic form to the scheduling module 56, which manages the schedules of the quilting machines 10.

Figure 2:
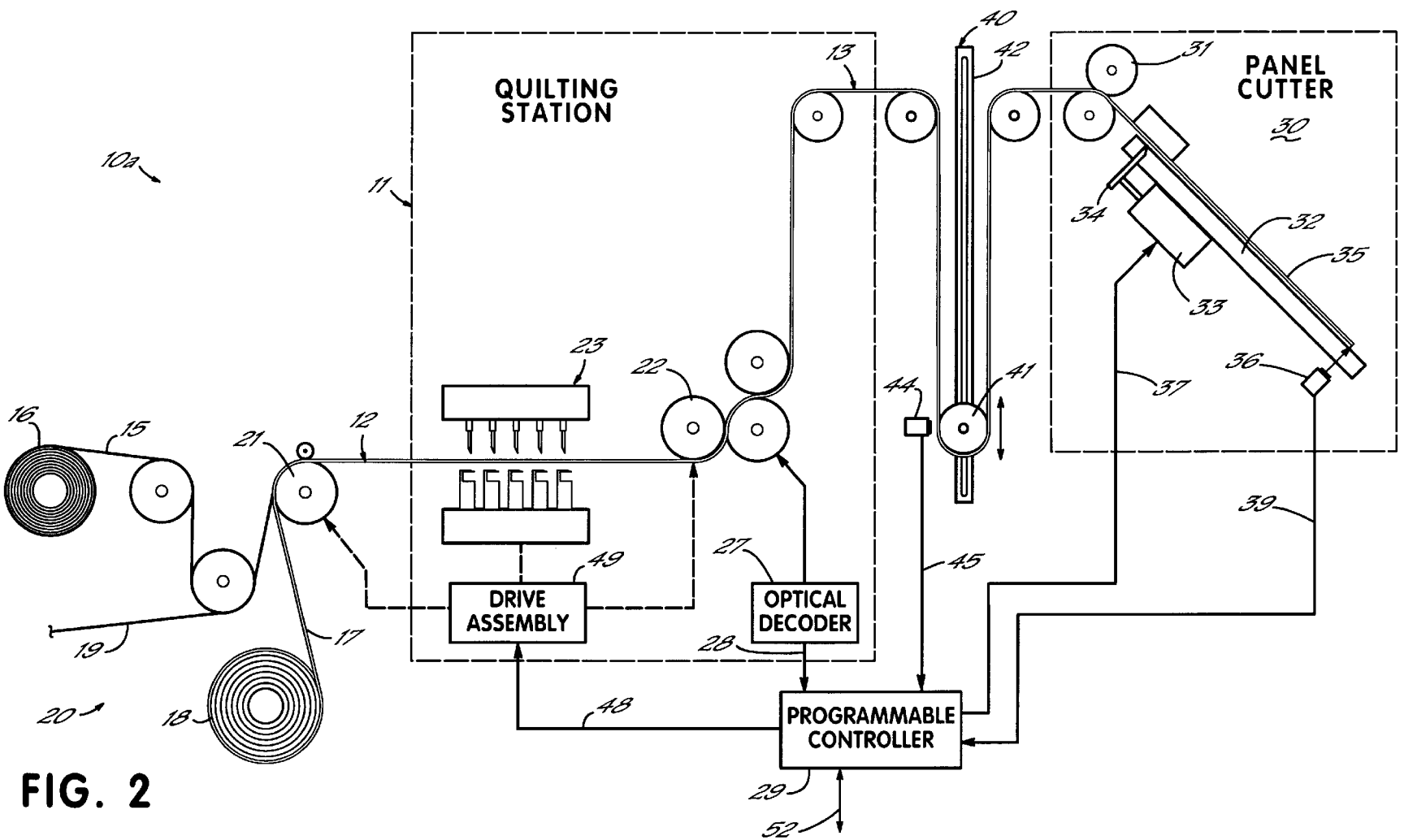
FIG. 2 is a diagram of a typical one of the quilting machines of the facility of FIG. 1.

Understanding of how the scheduling system 50 manages the quilting machines 10 is facilitated by an understanding of the quilting machines 10, particularly machine 10*a* illustrated in FIG. 2. The machine 10*a* includes a quilting station 11 at which stitched patterns are applied to a multiple layered web of fabric 12 to form a quilted web 13. The multiple layered web of fabric 12 is formed by combining a web of top goods 15 from a top goods supply roll 16, a web of backing 17 from a backing material supply roll 18, and a web of filler 19 interposed between the backing and top goods webs at the upstream end 20 of the quilting station 11.

The quilting station 11 has front and back sets of transversely extending, transversely shiftable, reversible rollers 21 and 22, respectively, which engage and move the web 12 relative to a stitching mechanism 23 at the quilting station. Of the rollers 21 and 22, the rollers 22 are the primary feed rollers of the quilting station that maintain tension on the web 12 between the rollers 21 and 22. The feed rollers manipulate the web 12 longitudinally relative to the stitching mechanism 23 to define the stitched pattern being applied to the web 12, and control the overall advance or downstream feed of the quilted web 13.

Attached to the shaft of one of the feed rollers 22 is a digital optical encoder 27, or other type of measuring instrument, for measuring the linear feed of the web 13 through the nip of the rollers 22. The encoder 27 has an output 28 input of a programmable controller 29, which is preferably a microprocessor based digitally programmable industrial controller. In the course of quilting, the web may be longitudinally reversed several times through the quilting station 11 in order to sew 360° or other complex patterns, so the encoder is direction sensitive. Other details of the quilting station 11 are set forth in U.S. Pat. No. 5,154,130 referred to above.

Downstream of the quilting station 11, the machine 10*a* includes a panel cutter 30 having a set of web feed elements 31 at its upstream end which engage the quilted web 13 being fed from the quilting station 11 and advance it onto a downwardly inclined table 32. The feed elements 31 are preferably opposed feed rollers which engage the quilted web 13 and maintain upstream tension on the quilted web 13. The panel cutter 30 includes a cutoff mechanism 33, which includes a transverse blade or knife 34 which cuts the quilted web 13 in response to a cutoff signal from the controller 29 along line 37, to transversely sever a finished quilted panel 35. At the lower end of the table 32 is a photo-detector or other sensor 36 operable to detect the presence of quilted fabric and send a signal along input line 39 to the controller 29.

Between the quilting station 11 and the panel cutter 30 is an accumulator section 40 which accumulates quilted web 13 fed from the feed rollers 22 and supplies quilted web 13 to the feed elements 31 of the panel cutter 30, and to resupply web 13 to the feed rollers 22 when the feed of the web 13 is reversed. The accumulator section 40 includes a transverse accumulator roll 41 that rides in vertical track 42 and is generally is supported by the web 13 such that the weight of the roll 31 maintains a generally uniform tension on the web 13. A limit switch or other roll detector 44 at the bottom of track 42 generates a signal along an input line 45 to the controller 29 to signal that the accumulator 40 is at its maximum capacity. A similar switch (not shown) may be provided at the top of the track 42 to signal that the accumulator is at its minimum capacity.

The controller 29 is programmed to respond to the signals at its inputs and to control the feed and cutoff in such a way as to synchronize the quilting, feeding and cutting so as to compensate for the shrinkage or gathering of the material during quilting that changes its dimensions. The shrinkage compensation is a solution to the problem caused by that fact that, in the process, the stitching sewn by the stitching mechanism tends to shorten the longitudinal dimension or length of the fabric due to the gathering of the material during quilting. The controller 29 predicts this shrinkage by repeated measurements. The amount of contraction or shrinkage varies as the quilted patterns are changed by the pattern control program of the controller 29. The shrinkage also varies as factors such as humidity in the plant vary, and due to other factors that cannot be readily predicted. The calculated shrinkage is used by the controller 29 to control the amount of feed of web 12 to the quilting station 11, to control the location of the quilted pattern in relation to the web 12, to control stitching mechanism 23 and drive assembly 49 to adjust the elongation or spacing of the quilted patterns so that they occupy the appropriate length or positions on the shrunken cut panels, and to control the feed of the quilted web 13 out of the quilting station 11. The control also uses the shrinkage calculation to either register the patterns on the web in relation to the locations of material splices on the web, or to signal where splices are to be made in the webs of fabric 15, 17 and 19 being fed to the quilter.

Each of the quilted panels produced by the machines 10 is a quilted product, and is produced on the machine 10*a* or on others of the machines 10 in response to scheduled data downloaded to the controller 29 via the network 52 from the scheduling module 56 of the scheduling system 50. The scheduling system 50 performs analysis of the quilting operation and returns information to the management system 60 which integrates it into the overall analysis of the factory 100.

The first operation performed by the scheduling system 50 upon receipt of the quilting production requirements from the management system 60 is the loading of the individual scheduling databases 55*a*, . . . , 55*n* of the scheduling information that will ultimately be downloaded to the controllers 29 of the quilting machines 10 to provide the machines 10 with their respective schedules of products or batches of products to produce. The scheduling system 50 is aware of the mix of machines in the facility and knows which machine is preferred for each product. The software in the module 56 of the scheduling system 50 makes a first pass at allocating a day's production to the mix of machines 10. The scheduling system operator, who is often the quilting department supervisor, may interact with the machine loading function of the module 56 through the terminal 53 to handle exceptions. For example, a supervisor may decide to schedule overtime on a heavily utilized machine rather than transfer products to a machine less suitable for producing them.

The output of the machine loading function of the module 56 of the scheduling system 50 is a list of products to be produced on each quilting machine 10 of the facility 100. Initially, there is no order to the lists. The scheduling system 50 then, in its next operation produces a production order to each machine's production list. In ordering the list, the scheduling system 50 analyzes the items on the list and places the items in optimum order for production by each individual machine. It does so by taking into account several factors, including changes in needle settings, changes in materials, including ticking or facing material, filling material and backing material, and changes in pattern. Priorities such as the need to expedite certain products to meet customer requirements is also taken into account. The scheduling system 50 seeks to minimize the number of material changes and needle setting changes to thereby significantly reduce the time required to produce a particular list of products.

The scheduling system 50 allows user selection of the factors deemed most important to the operation of the factory 100. The schedule ordering process, like the loading operation, is interactive. The scheduling system operator may override decisions made by the scheduling software of the module 56 of the scheduling system 50 to take into account special situations. The automated scheduling process performed by the scheduling system 50 optimizes the schedules of the machines 10 based on the current settings of each quilting machine 10. The settings of each machine 10 are communicated through the network 52 to provide the module 56 with information on such factors as the current needle settings of the machines and the materials currently loaded into the machines.

Following the ordering of the individual machine schedules, the schedules are electronically downloaded to storage modules within the controllers of each of the quilting machines 10, such as to the controllers 29 of machines 10*a*. This downloading operation does not require scheduling operator intervention and does not interrupt the ongoing production of the machines 10 while scheduling information is being loaded. Schedule changes that may occur are handled simply by the scheduling operator bringing up a schedule for a target machine 10 on the terminal 51 of the scheduling system 50. The scheduling system operator may manually make the change or merely enter general schedule change information and allow the software in the module 56 of the system 50 to choose the optimum place to insert the change in the schedule or to select the particular details of the schedule needed to implement the change.

The scheduling system 50 also provides real time feedback of production statistics and quilting machine status to the management system 60 and to the scheduling system operator or supervisor at the terminal 51. The feedback includes snapshot views of the status of quilting production at any time, which provides information on what orders are completed and what are not, along with estimated completion time. The system 50 also produces machine efficiency reports for each quilting machine 10. The reports include, for example, the number of items of products produced, total available run time of a machine for the day, actual running time of the machine number of changes of material including the total downtime of the machine while making the changes, reasons for stops, including worker breaks, machine maintenance, material outages, and other reasons, plus the stoppage times involved. The history of the machines is used in the scheduling process by making the prediction of machine performance more accurate. This prediction is used in the automatic scheduling as well as to provide simulation of the scheduled runs to the scheduling operator at the terminal 51 to provide opportunities for the modification of the schedules before the schedules are run.

In the course of performing the scheduling function the scheduling system 50 communicates information back and forth between the system 50 and the individual quilting machines 10. Some of the information is that needed by the scheduling process while other information is communicated to centrally maintain and back up information stored within the individual quilting machines. The types of information include, for example, the following files, tables or databases:

1. Top Goods File—The Top Goods file contains information about the top goods or ticking used to build a product or panel, as, for example, the top goods 15 from the top goods supply roll 16 in FIG. 2. Records in this file contain a Top_Goods_ID and a Top_Goods_Description. Primary purposes of this file are to serve as a checkpoint for the usage of the top goods in the products or panels and to minimize material changes. The quantities and locations of the various rolls or supplies of this material are maintained in related files in the scheduling system 50.
2. Fill Goods File—The Fill Goods file contains information about the filing material options that could be used in panels of quilted products.

Examples are DACRON, and Poly (all sizes). Records in this file contain a Fill_Goods_ID and a Fill_Goods_Description. Primary purposes of this file are also to serve as a checkpoint for the usage of the fill goods in the products or panels and to minimize material changes. As with the top goods, the quantities and locations of the various rolls or supplies of this material are maintained.

3. Backing Materials File—The Backing Materials file contains the information on backing material for use in making quilted panels. Records in this file include a Backing_Material_ID and Backing_Material_Description. Examples are Light and Heavy Backing. Primary purposes of this file are to serve as a checkpoint for the usage of the backing material in the products or panels and to minimize material outages or changes. As with the other materials, the quantities and locations of the various rolls or supplies of this material are maintained.
4. Machines File—The Machines file is the quilting machine identification file, and contains information about the quilting machines 10 available in the facility 100. This file contains the Machine_ID, Machine_Description, and parameters of the machine for consideration in preparing the schedules, such as: Machine Top Speed, Machine_Carriage Travel, Machine_Automation, Average_Yards_Per_Hour, Machine_Class, and other parameters.
5. Shape Files—The Shape files contain information about the patterns that a quilting machine is capable of running. Each quilting machine has stored therein a Shape file for each pattern shape that the machine can produce. This data is made available to the scheduling system 50 for backup and for downloading new pattern shape files to machines 10. Included in the Shape files are Pattern_ID, Pattern_Description, Pattern_Type (continuous or TACK & JUMP™ (discrete pattern arrays), Pattern_Class, Shape_Image and the sets of commands needed by a machine to move the material and sewing elements to quilt the respective patterns.
6. Products Filed—The Products file is the actual bill of materials for a quilted panel. The file contains all of the information that a quilting machine 10 needs to quilt a panel. The records in this file contain information on the materials to be used, the pattern to be quilted, the quilting machine settings and the panel cutter settings. These include, for example, Product_ID, Product_Description, Pattern_ID (which links to the Shape file), Pattern_Type, Units (English or metric), Pattern_Length, Pattern_Width, Stitch_Size, Speed_To_Run, Needle_Setting, Feed_Compensation, Carriage_Compensation, Number_Of_Tacks (pattern repeats), Feed_Jump (distance between repeats), Tail_Length, Top_Goods, Fill (combinations 1 through 4), Backing, Panel_width, Panel_Length, Default_Machine, Panel or Windup, Average_Run_Time, Pattern_Class, and other product parameters.
7. Stops Codes File—The Stop Codes file defines the stop codes to which the quilting machine operators must respond if it is stopped, for example, for over 2 minutes. Stop codes are a dimension for tracking operator and machine efficiency and also provide early warning of necessary machine maintenance.
8. Jobs File—The Jobs file contains the job schedule data and is a primary file in the scheduling system 50. The purpose of the Jobs file is to serve as a work area for a quilting scheduling manager routine in the module 56 of the scheduling system 50. Data in this file includes separate sub-files of data for each of the machines that contain records specifying what panels are to be made and the order in which the panels are to be run. The basic information in each record identifies the product to be made on a particular machine, specifies the quantity to be made and sets forth a desired scheduling order. The data in this file include Production_Date, Production_Shift, Schedule_Code, Product_ID, Location_ID, Sales_Order_Number, Run_Priority, Run_Number, Route_Sequence, Machine_ID, Job Type, Production_Quantity and a Submission_Identifier.
9. Working File—The Working file is much like the Jobs file, but serves as an working area for the scheduling operator to work with a schedule without effecting the run of a machine currently in use. Its purpose is to allow the user to try various scenarios to see the possible combinations that a days run will allow. It contains all or most of the variables of the Jobs file. From this file, simulations can be run which utilize machine and operator history to test different possible schedules.
10. Production File—The Production file contains information on all of the panels that have been produced for a particular run. The Production file information can be collected at any time. The records of this file contain data of Machine_ID, Production_Date, Product_ID, Measurement_Units, Product_Length, Product_Width, Offset_Of_Panel, Panel_Type, Time_Produced (Greenwich mean time, for example) and Production_Quantity. One production file record is generated each time a machine completes an item from a Jobs file record.
11. Events Log File_The Events Log file is a log that contains a record for each pertinent event that occurs. Events such as material changes, machine stops and starts, reasons for stops, the cutting of completed panels and other such events are recorded in this log. This log is the holding point for the history of every event that happens throughout the day in a particular machine. This file will serve as the main history file for tracking daily runs, waste, cuts and crops, machine errors, and machine stops. The records in this file contain Date_Time stamps, Event_Code, Machine_ID, Product_ID, Fault_Stop marks, and other machine information.

In this file, or preferably in a separate diagnostic log, is maintained information such as communication statistics between the scheduling system 50 and its subsystems, including the commands processed. The diagnostic log information is available on demand for troubleshooting purposes.

Certain data must first exist before a facility can begin using the scheduling system 50. First, files must be set up to reflect the operation of the facility 100. These are the Top Goods, Backing, and Fill Goods files, and the Machine and Pattern Shapes, which are loaded with data to identify the machines at the facility 100, the patterns that the machines are capable of producing, and the materials available from which the quilts are to be made. Usually, the quilting machine manufacturer is able to provide Pattern Shapes files for a given quilting machine 10. Once these files are complete, the user must setup the Products file to identify the products that the facility 100 makes. The files should be created and loaded in the above order to allow appropriate checks to be done while the files are being set up, to minimize unnecessary errors that could occur on the machine as well as unnecessary material crops due to these errors. Stop Code data is also loaded into the Stop Codes file at this time if the user elects to track stops that machine operator makes during a day.

Once the files defining the machines and the products and their components are established, the facility begins the scheduling process. With multiple machines 10 at the facility 100, the computer of the scheduling system 50 can advise the scheduling operator regarding a balanced scheduling load for the quilting machines 10 at the facility. The schedule module 56 looks at the production requirements, the machine capabilities and machine loads to determine possible combinations to run. If a balanced load is selected the runs for a given machine can be modified by the scheduling system operator in the single machine schedule mode. In a typical single machine schedule run, the scheduling operator may begin by incorporating data for a given period of time based on production criteria. Using those criteria the run can be optimized for a given machine. Using the selections from previous schedule attempts, the scheduling operator can choose to discard or accept the schedule, and to download the schedules to the machine automatically.

With automated quilting machines such as machine 10*a* described above, feedback can be received by the scheduling system 50 from the controllers 29 of the machines 10 with information regarding what has been accomplished during whatever time frame is selected. Feedback received shows productivity, efficiencies, work stoppages during the day, and quantities produced. Information about production quantities can be exported to a common format for import into other production systems.

With event logging, the productivity of a day, week or month can be examined at any time during a production day. The reporting features include machine start and stop times, cumulative lengths of finished product produced, length of product produced per hour, length of material waste, waste percentage, stops, change-overs and much more.

At any point in a day, managers, owners, and supervisors can see live production data as panels and product move through a specific quilter. This can serve a number of functions. It serve as an early warning if production standards aren't being met for the given day so steps can be taken to make corrections. It can show obvious inefficiency in a machine, or that scheduling has optimized production, even whether the optimization is to a point that production is ahead of schedule.

While, once setup of all the necessary files is made, these files are exported or downloaded to the individual machines, existing data can also be imported from any of the quilting machines 10 to the scheduling system 50. This feature enables the optimization of the setups where products have been set up in the quilters initially. It also serves as a backup among multiple machines.

The scheduling system 50 also has the ability to import production data from other production systems, for example, where provided in a comma delimited format. Production data can be exported to other production systems in a similar format.

The scheduling system 50 communicates with the individual quilting machines of the preferred type 10*a* with the commands set forth in Table 3.

TABLE 3

| Commands sent from Scheduling Computer 50 to Quilting Machines 10: | |
|---|---|
| CLCKJOBS.XXX - | Freeze Quilting machine temporarily. This will lock stop the quilting machine if it runs all the materials up to the "point of no return". * |
| CGETJOBS.XXX - | Tells the quilting machine that a file exists that contains a current schedule. This command will reset the jobs file completely. |
| CPUTJOBS.XXX - | Tells the quilting machine to output the current schedule including any added items. |
| CADDJOBS.XXX - | Tells the quilting machine that a file exists that needs to be appended to the current schedule. This command will append to the current jobs file. |
| CUNLKJBS.XXX - | Tell the quilting machine that schedule updating has been completed and it can start processing the current schedule. |
| CPUTLOGS.XXX - | Request the events log from the quilting machine. The events log contains information about events that have taken place in the quilting machine since the last shutdown. |
| CPUTDONE.XXX - | Request a current complete production file from the quilting machine. This request tells the quilting machine to remove the production information from its memory. |
| CLOOKDNE.XXX - | Request a current complete production file from the quilting machine. This request tells the quilting machine to retain the production file in its memory. |
| CREPLPRD.XXX - | Tells the quilting machine that a file exists that contains a complete products tile. The quilting machine will then replace its working product file with the sent file. |
| CUPDTPRD.XXX - | Tells the quilting machine that a file exists that contains products that need to be added to the products file. The quilting machine will retain the working products file and add the sent items. |
| CPUTPROD.XXX - | Tells the quilting machine to put the products down to the Windows 95 disk. |
| CGETPATS.XXX - | Tells the quilting machine to output a current list of patterns that the quilting machine holds. The patterns are stored in a new directory called patterns. |
| CPUTPATS.XXX - | Tells the quilting machine that new patterns have been put in the pattern directory. The quilting machine will then load the patterns. |
| CLOOKRUN.XXX - | Request an list of active jobs. Outputs the run queue or jobs in process. |
| CSET_PONR.XXX - | Set a Point in which a put jobs will receive forward (Point of No Return). Requires SET_PONR.TXT to function correctly. |
| CCLR_PONR.XXX - | Clears the Point of No Return.* |
| CPALLJBS.XXX - | Put all Jobs, even those above point of no return.* |
| CPTAUDIT.XXX - | Put all audit trail data base info. |
| CDLAUDIT.XXX - | Delete's Audit |
| CPUTPNEL.XXX - | PUT the panels database. |

TABLE 3-continued

| Commands sent from Scheduling Computer 50 to Quilting Machines 10: Commands sent to Scheduling System 50 from Quilting Machines 10: | |
|---|---|
| LOCKSTOP.UCM - | Informs WINDOWS 95 that the quilting machine is stopped due to a LOCKJOBS.CMD that has been sent and not cleared. |
| NEEDJOBS.UCM - | Informs WINDOWS 95 that the jobs queue has become low and the machine is in need of more work. |
| MACHSTOP.UCM - | Informs WINDOWS 95 that the quilting machine has been stopped. This stop could be for any number of reasons and does not signify that quilting machine is waiting on WINDOWS 95. |
| SCHDSTOP.UCM - | Informs WINDOWS 95 that the machine is stopped due to lack of jobs in the schedule file. |
| SHUTDOWN.UCM - | Machine is shutdown. |
| | Misc Files Used: |
| SET PONR.TXT - | File which is required to set point of no return. Need one line of 15 characters specifying the product ID + 2 blank space + a ten character unique identifier. |
| PRODUCTS.XXX - | File created by Windows 95 system that contains a current products List. |

Note:
The "point of no return" is determined based on the splice points of the quilting machine. There is a point in which the quiiter must run a certain amount of the jobs it has loaded and cannot be modified.
Note2:
Also note that XXX represents a terminal ID created by Windows 95 system that makes each command unique.

Figure 3A:
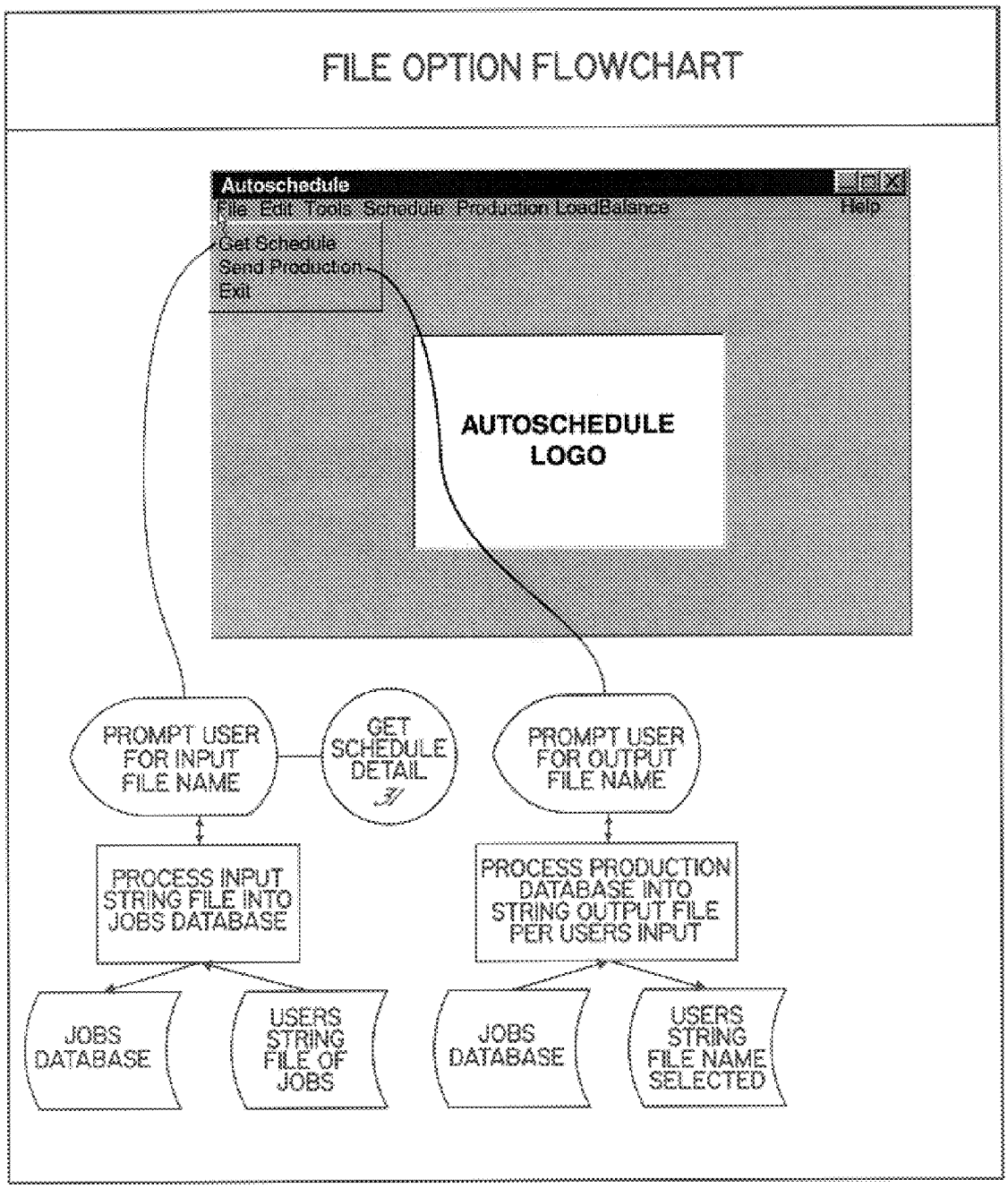
FIGS. 3A–3P are flow charts of the programs of the scheduling system computer of the facility of FIG. 1.
Figure 3B:
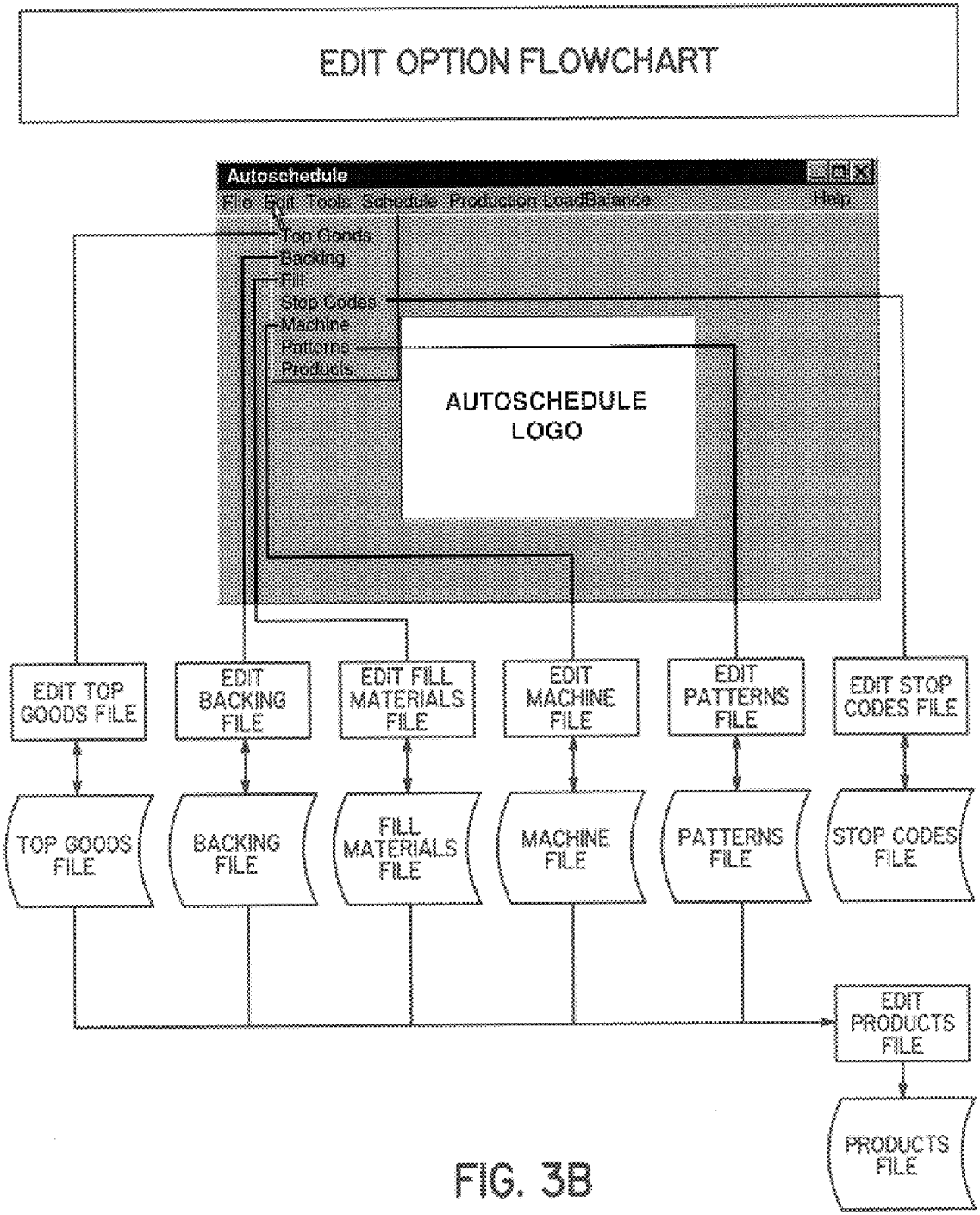
Figure 3C:
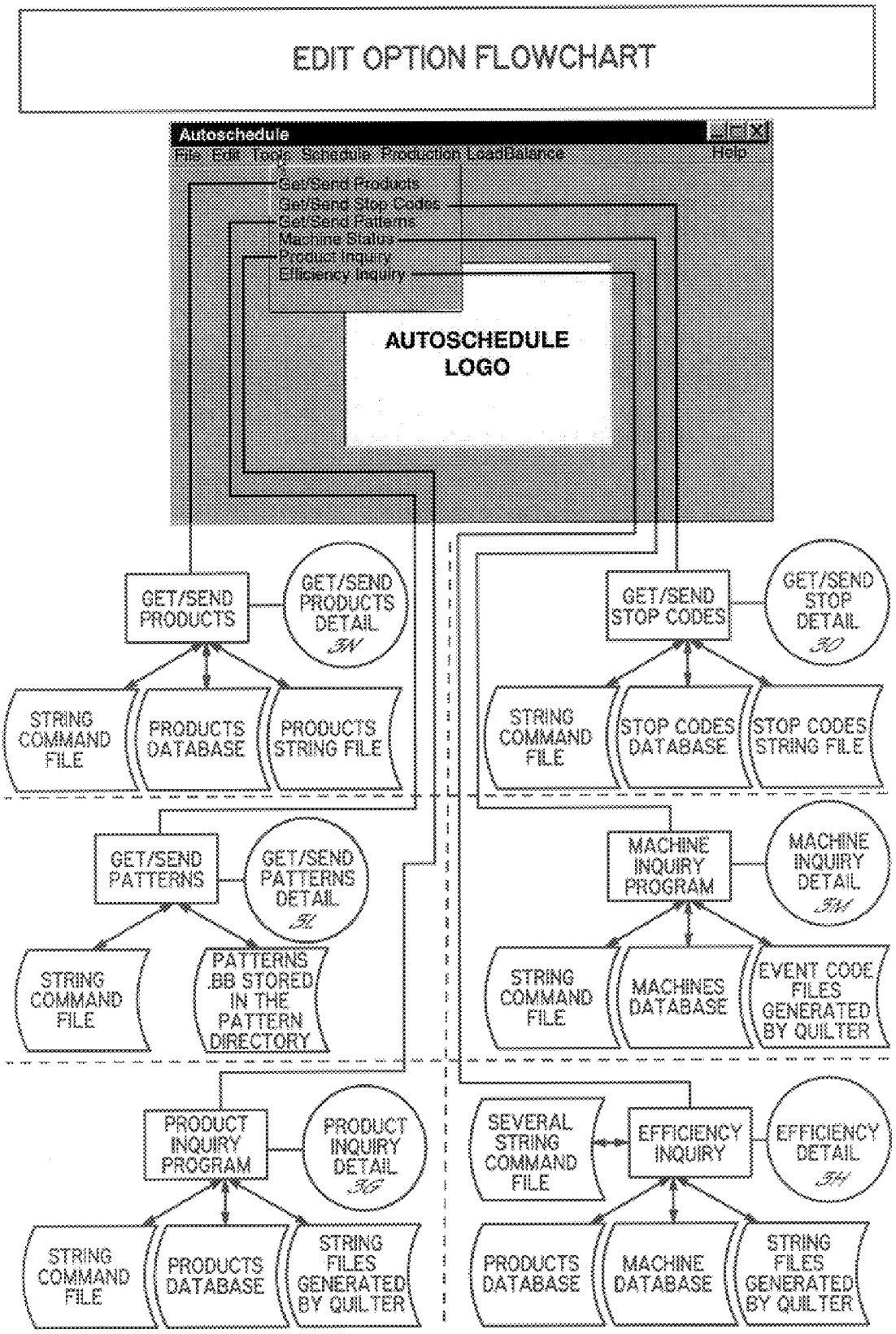
Figure 3D:
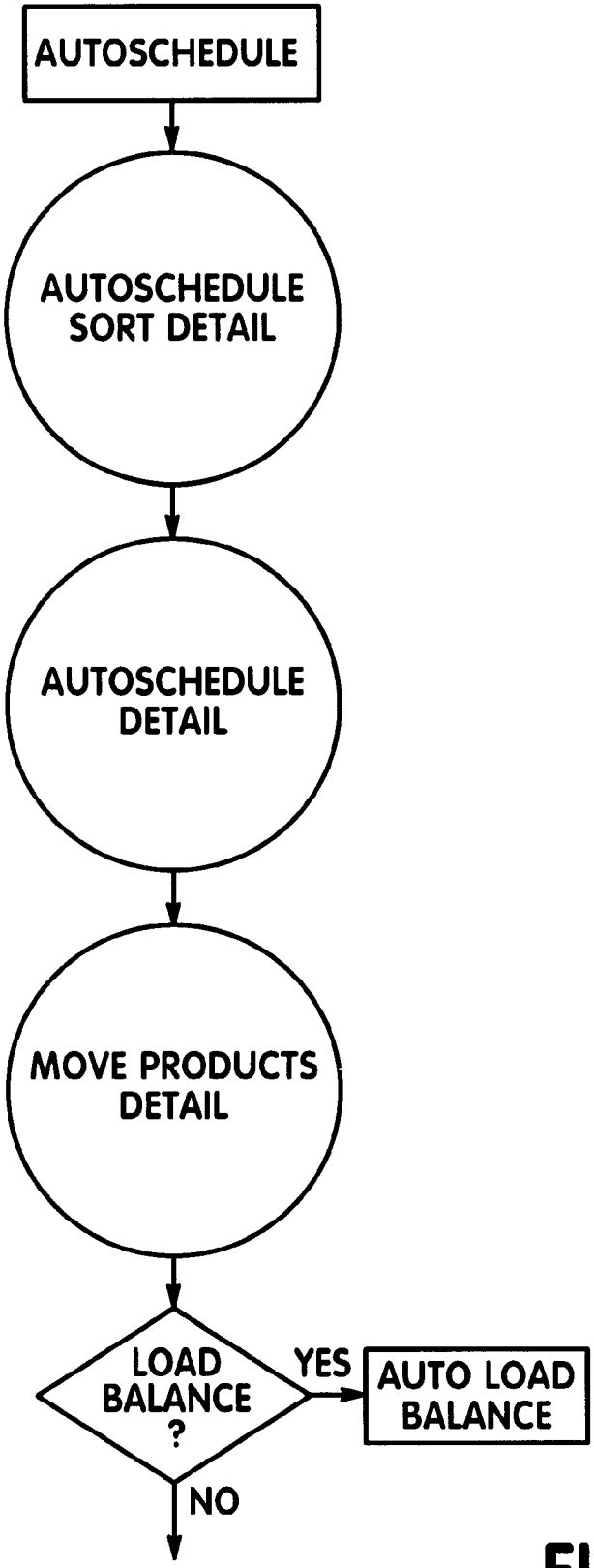
Figure 3E:
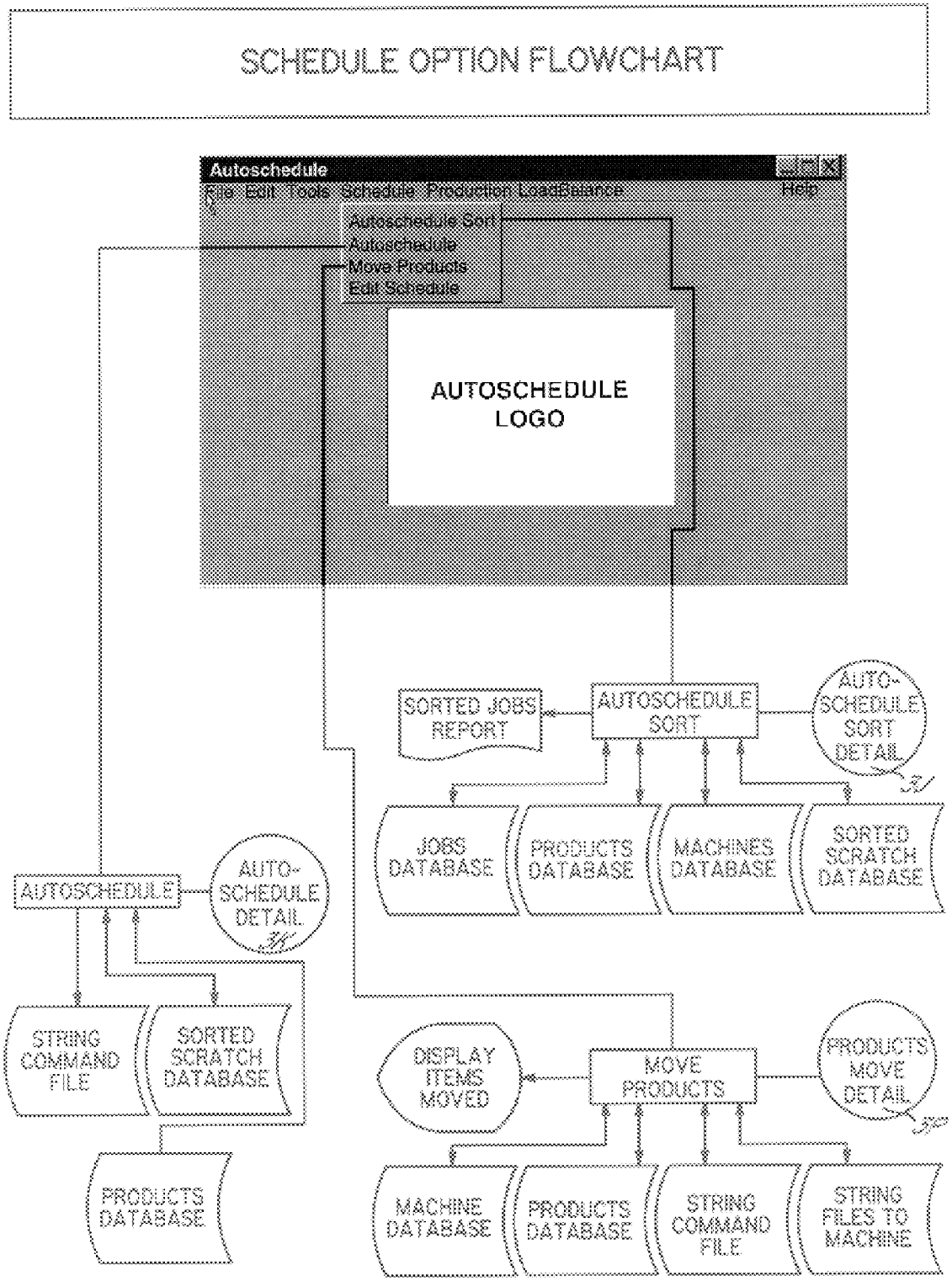
Figure 3F:
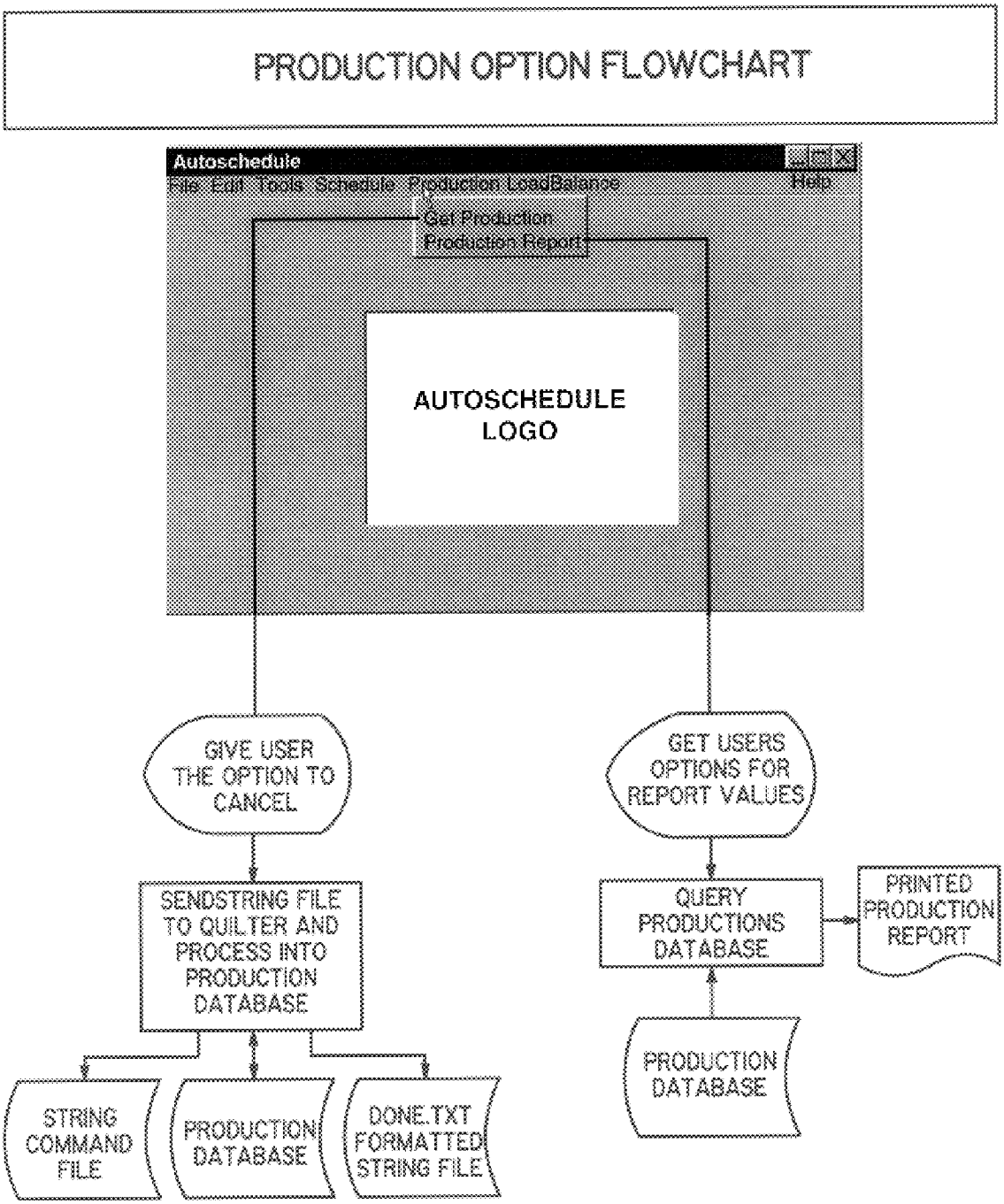
Figure 3G:
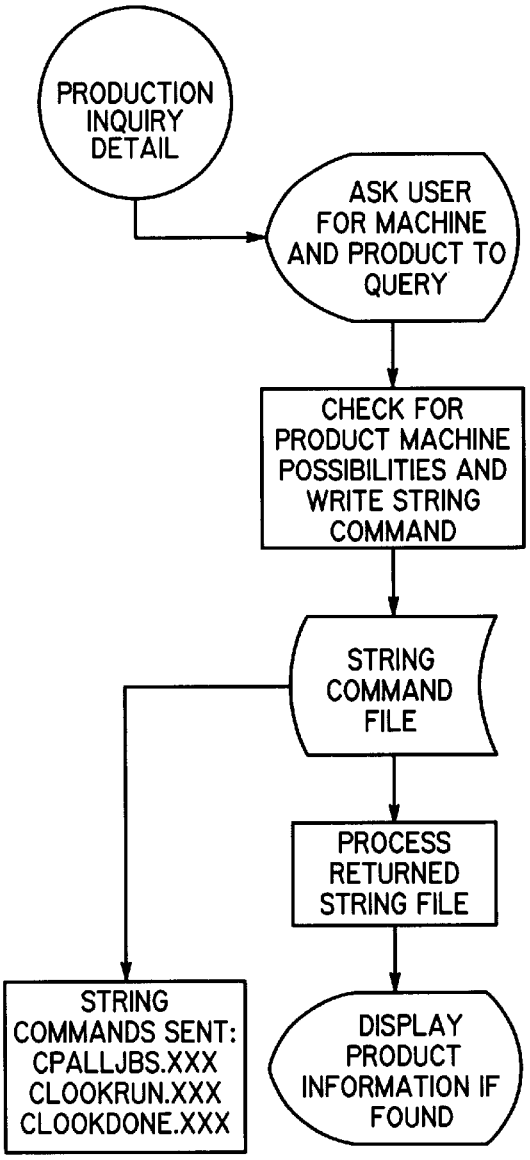
Figure 3H:
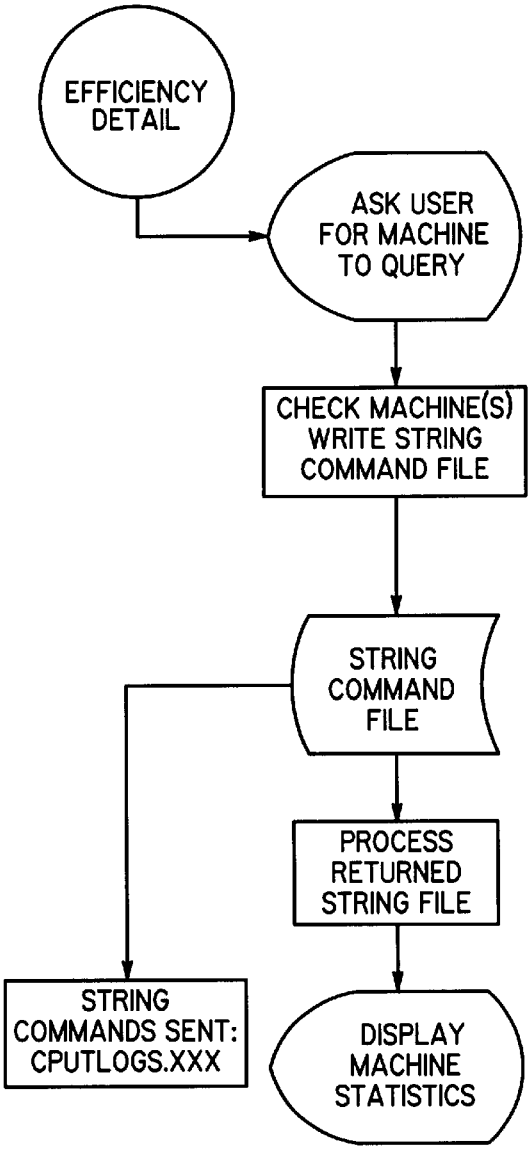
Figure 3I:
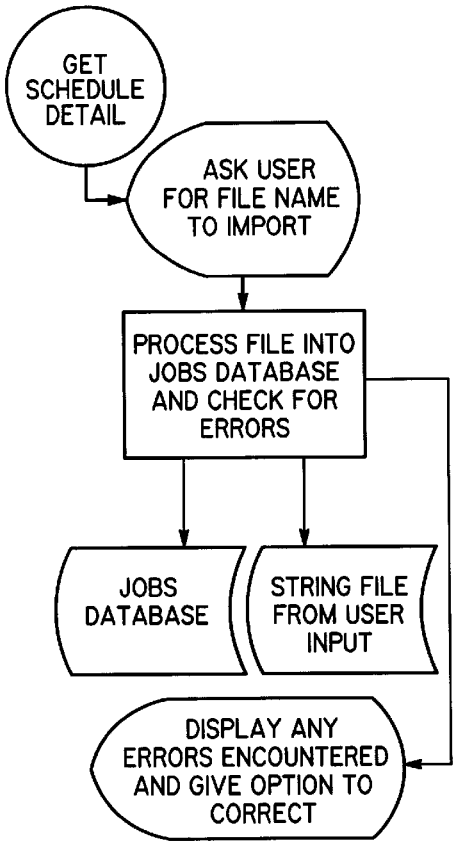
Figure 3J:
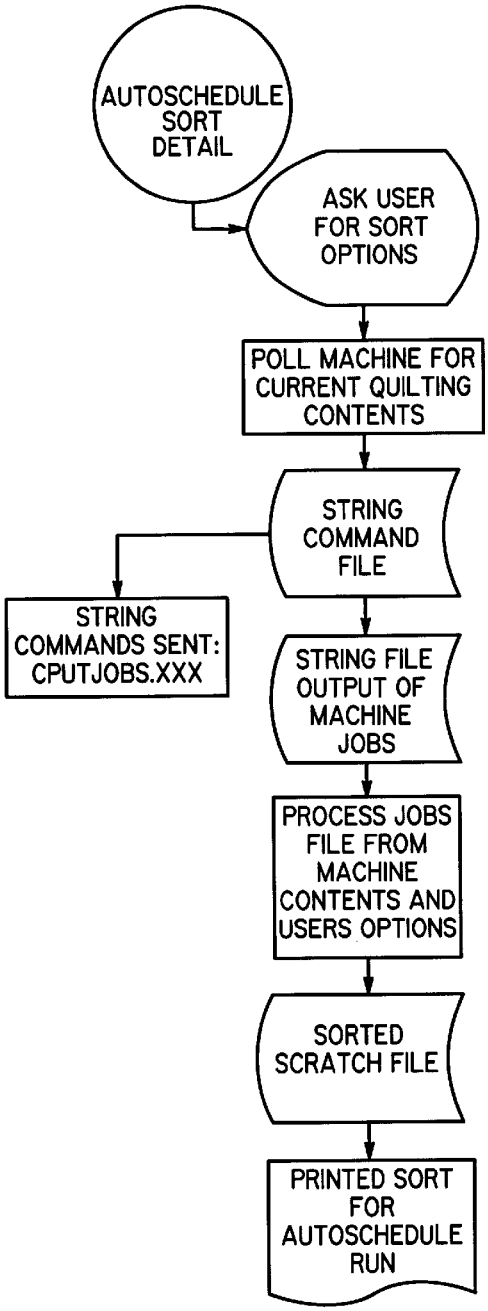
Figure 3K:
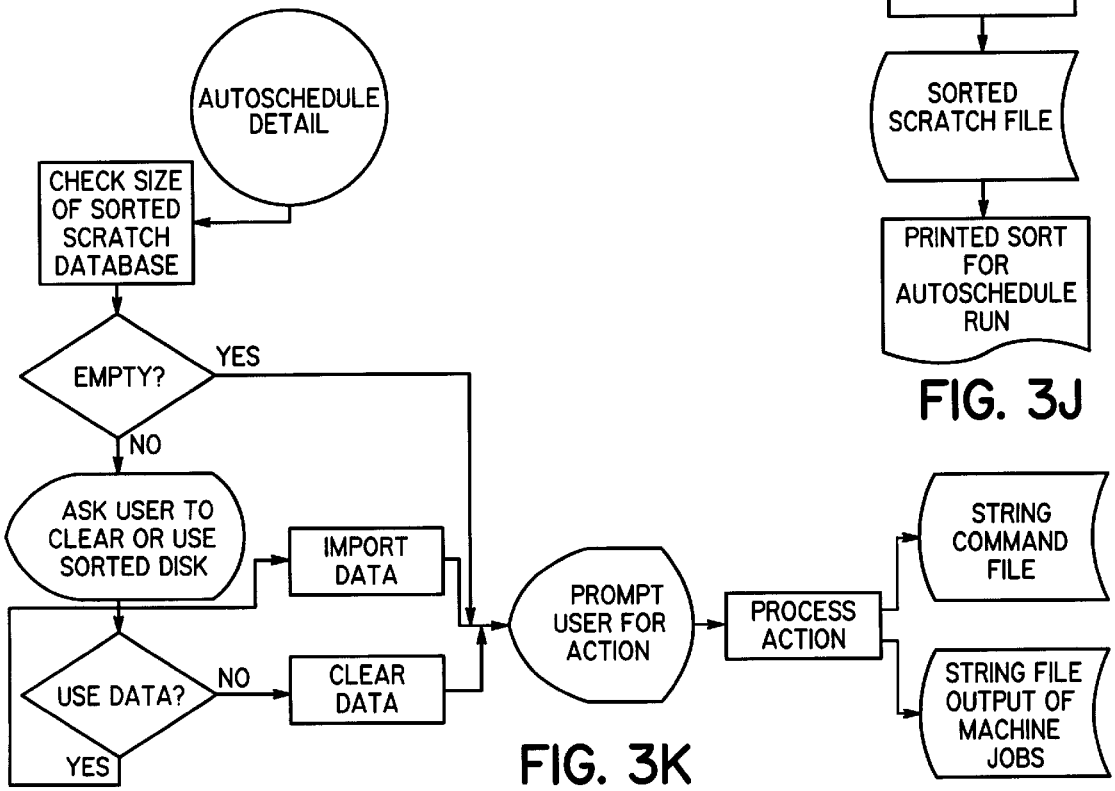
Figure 3L:
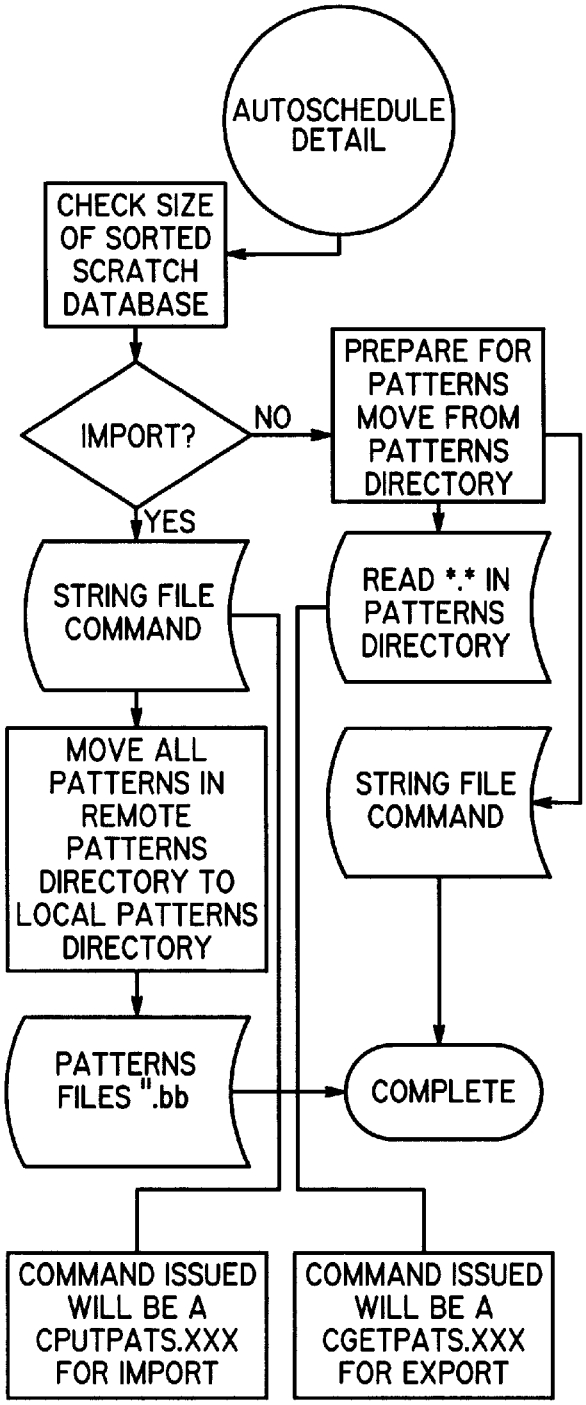
Figure 3M:
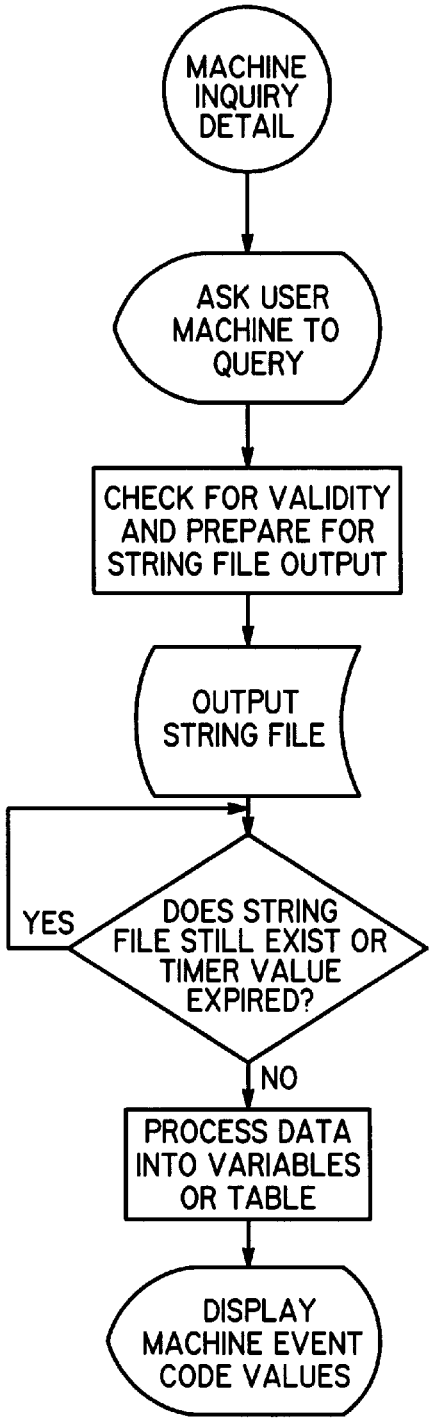
Figure 3N:
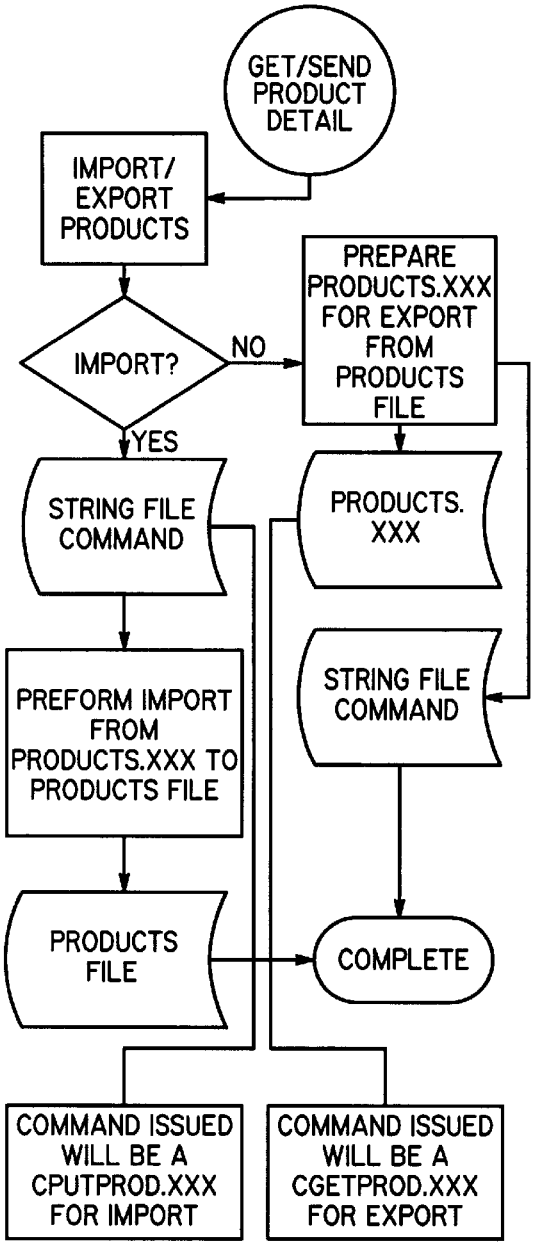
Figure 3O:
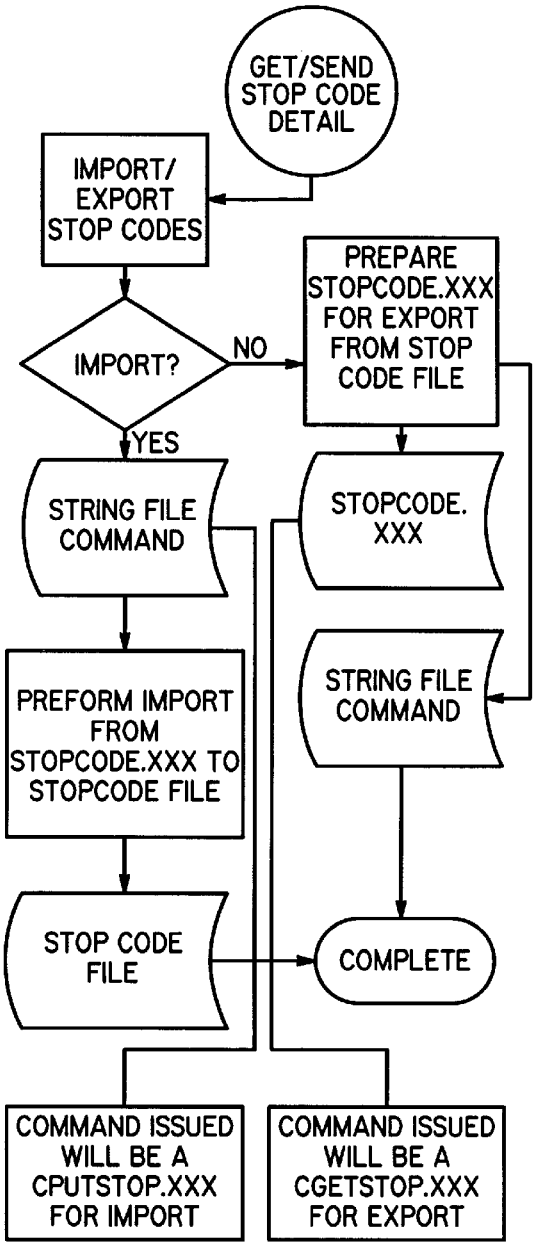
Figure 3P:
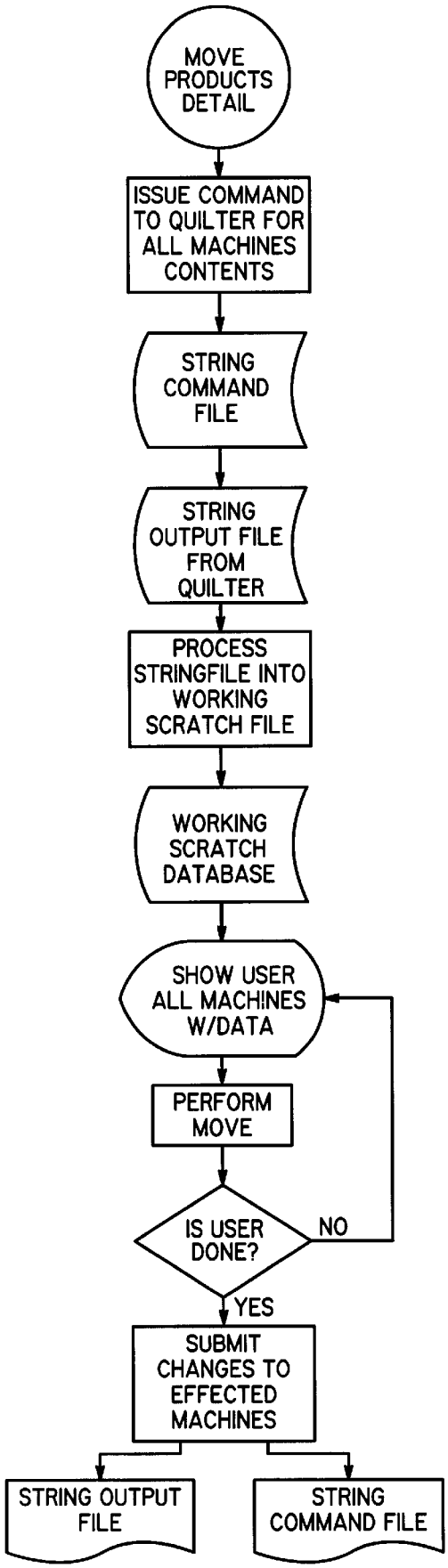

FIGS. 3A–3P are flowcharts depicting one of many forms that programs of the scheduling sub-system 50 can take to provide the features of the invention discussed above. Where the scheduling subsystem 50 is used in conjunction with a facility's factory management subsystem 60, scheduling data may be imported from facility management computer 60 by selecting the Get_Schedule item on the File pull down menu of FIG. 3A. The imported data is either in, or is be converted to, the data format of the scheduling subsystem computer 51. This imported data contains records that can replace or be appended to the Jobs file defined above in the scheduling computer 51. A schedule, once imported, is processed by the autoschedule computer 51 in arriving at the overall schedule for the facility. Where the autoschedule system 50 is used as a standalone system without a management subsystem 60, order records are added to the schedule manually using the Edit_Schedule option under the Schedule menu. By selecting the Send_Production item on the File menu, production status including data of the completed jobs and the details thereof are communicated to the management subsystem 60.

The Jobs database is linked to data in other database files, specifically the Products File described above, which is in turn linked to other database files including the Top Goods file, the Fill Goods file, the Backing Materials File, the Machines file, and the Patterns or Shapes file, all described above. In addition, the Stop Codes file is provided to store machine events, also described above. These files can be individually edited by selection of items under the Edit menu, as illustrated in FIG. 3B. Selection of a file from the Edit menu opens a corresponding "File Maintenance" window for performing the file edit. The Products Maintenance window for editing the Products file is illustrated in FIG. 4A. Similar file maintenance screens for editing Machines, Stop Codes, Pattern Shapes, Top Goods, Backing Materials and Fill Goods are illustrated in FIGS. 4B–4G, respectively. Where depicted in the drawings, depression of a command key or function key such as the F2 key drops down a screen which lists the records in the respective database, which can be selected by entry of a corresponding identification number to open that record in the maintenance screen window.

In addition to manually editing the Products file, products files can be imported from or exported to individual machines by the respective selection of the Get/Send_Products item from the Tools menu, as illustrated in FIG. 3C. This selection opens with window illustrated in FIG. 4H. The imported or exported file can be caused to replace the target file at the autoschedule system 50 or at a selected machine 10, or can be appended to the target file. Similar screens open when the Get/Send_StopCodes and Get/Send_Patterns items are selected, to allow similar importing or exporting of the corresponding files from and to the machines 10 to and from the autoschedule system 50. Inquiries can also be made to load data from the machines concerning Machine Status, current Product being produced and Efficiency data, by selecting the corresponding items on the Tools menu.

As illustrated in FIG. 3E and referred to above in connection wit h FIG. 3A, if records are not imported into the Jobs database, they may be entered manually by selecting the Edit_Schedule item on the Schedule menu. This opens the screen illustrated in FIG. 4L. In this screen, a job or order can be defined manually by entering the product identification and scheduling parameters as call ed for on the screen. From the Schedule menu ma y be selected an optional function called the Autoschedule_Sort function by which a suggested job schedule for all of the quilting machines can be calculated. This selection opens the window illustrated in FIG. 4M through which a production time period is entered When this is selected, the software at the autoscheduling computer 51 tallies what is already running on the machines and what has been qued, and determines, based on parameters of time available, quilting yardage required, and quilting machine workload capacity, whether a schedule that will work for the time and jobs specified is possible. If not, an OVERLOAD indication is made identifying the problem that must be resolved. Such an indication as well as the schedules suggested for each machine, are displayed by opening a window for each machine, as illustrated in FIG. 4N. If the suggested schedule is accepted, the Edit_Schedule item is automatically selected to provide an opportunity to change the suggested schedule.

Figure 4Q:
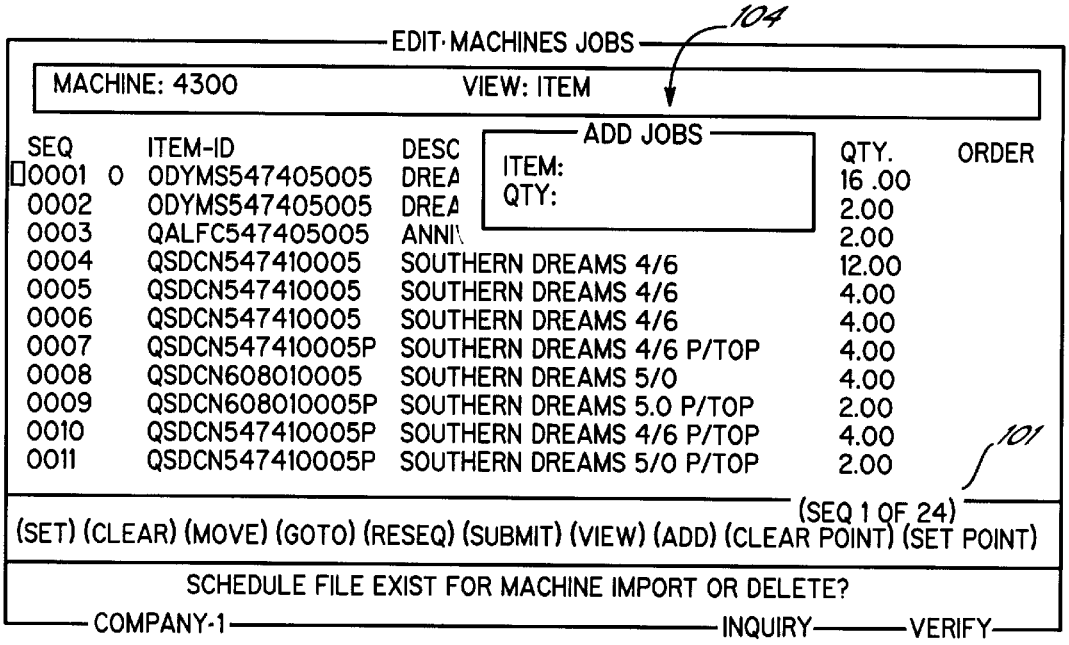
FIGS. 4A–4W are screen diagrams used in connection with the flowcharts of FIG. 3.
Figure 4R:
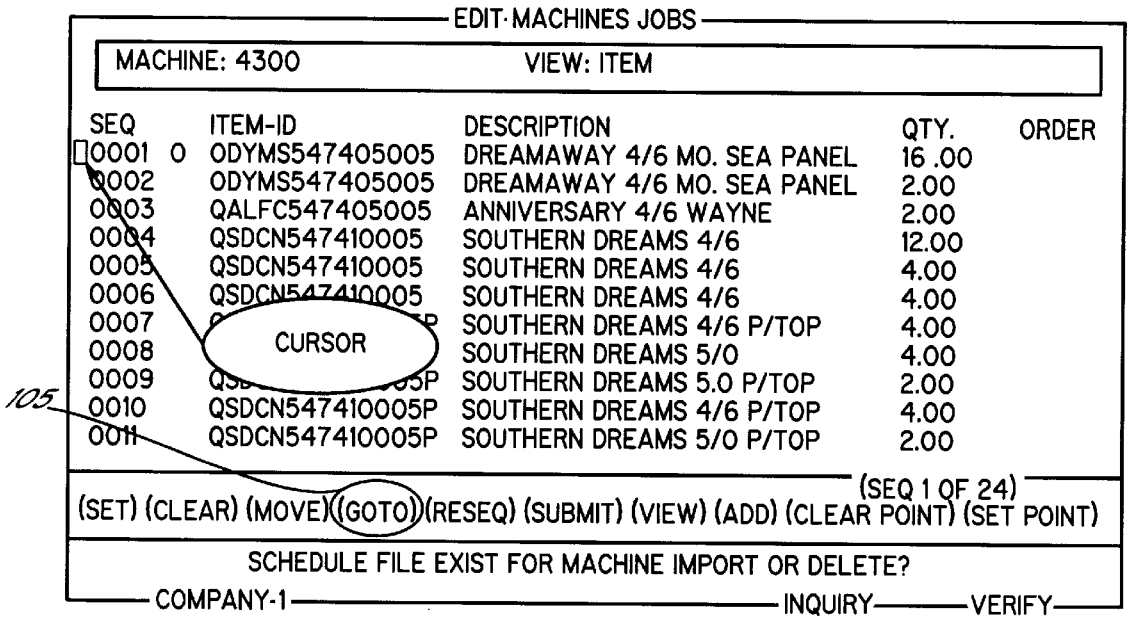

The Edit_Schedule may be changed manually by selecting the Edit_Schedule item on the Schedule menu. Whether manually selected or initiated automatically, the window illustrated in FIG. 40 is opened. The number of the quilting machine 10 whose schedule it is desired to view and/or edit can be entered or selected from a machine list, displayed by pressing a command such as the F2 function key. The schedule of quilting jobs for the selected machine is that of FIG. 40. A selected job is marked by a cursor and the number of total jobs scheduled for the machine is indicated in a field 101. The details of the selected job can be displayed by selecting the View command 102 from the screen or typing V to toggle to and from the detail screen, a sample of which is illustrated in FIG. 4P. As illustrated, the product identification for the job, the quantity to be produced, materials used, as well as needle array identification or number of needles to be set and a job sequence number are provided.

Where a job is to be added to the schedule, an Add command 103 is selected, which opens the inset window 104 illustrated in FIG. 4Q. A job is added by entering a product number and quantity, or by pressing a command key such as F2 to display the Products list from which a product may be selected. By selecting a Go command 105, as illustrated in FIG. 4R, and entering the Sequence Number of an item, the cursor can be moved directly to an item in the schedule.

An Item at the cursor can be selected by activating a Select command 106, or typing an S, as illustrated in FIG. 4S. More than one such item can be so selected, and the number selected is displayed in a field 108 on the screen. A Clear command 107 clears all selected items from the list. A Move command 109, illustrated in FIG. 4T, moves all of the selected items to the position immediately below the cursor, illustrated at 110, on the schedule for the machine being displayed, where the moved items will be inserted in the order in which they were selected. Selected items can also be cut and pasted to another machine, provided that machine is equipped to make the product, which will be determined by the existence of the product definition in the product list stored in the memory of the controller at the target machine.

When the schedule is acceptable, it is sent to the respective quilting machine 10 by selection of the Submit command 111, as illustrated in FIG. 4U. or by typing a U, for example. Before such submission, the position 112 of the cursor is noted or repositioned to define the Set Point in the schedule for the machine, as explained in connection with the discussion of FIG. 4W below. This Set Point is the point in the schedule at which the machine is to start. Items above the set point are usually completed items for which production data has not yet been loaded to the autoschedule computer 51.

To completely override the sequence suggested by the Autoschedule software, a Resequence command 113 can be selected, as illustrated in FIG. 4V. This command opens a Resequence window 114, which contains a list of predefined sort options, such as by needle setting, top goods type, etc. or a nested plurality of such features. When a resequence order is selected, after viewing, it can be undone to return to the automatically suggested sequence. Once resequenced, the schedule is submitted as described above.

Further, Set Point of a machine, that is, the point in the schedule at which the machine is executing the schedule, can be cleared and reset by selecting the commands 115,116 illustrated in FIG. 4W.

The Schedule menu of FIG. 3E also provides for the selection of three items, which call for certain of the screens referred to above under the manual Edit_Schedule item. These are three parts of the automated scheduling mode that can be activated by selection of items Autoschedule, Autoschedule_Sort and Move_Products, which initiate routines set forth in detail in FIGS. 3K, 3J and 3P. Preferably, however, all three parts are combined in a single Autoschedule routine selected as illustrated in FIG. 3D.

With the Autoschedule routine performed as in FIG. 3D, selection of Autoschedule under the Schedule menu prompts the user for sort information by which the user designates fields for use in modifying a proposed optimum schedule that will be automatically generated. The information provided by the user also designates job criteria, including the production time segment, that is the beginning and ending points of the production run, for the jobs that are to be rescheduled. In response to this input information, the autoschedule computer 51 automatically imports all of the jobs below the "set point" of each machine that match the criteria and assigns them to default machines that are specified for each of the defined products in the Products file. Jobs above a machine set point are those completed, in progress, or queued to the point that their rescheduling would disrupt production. If no default machine data is provided the software makes the closest fit between product and machine capabilities and assigns the job based on the fit.

The jobs are sorted based on a nested sort order that is deemed most efficient, considering, for example, the number of material changes that would result, the number of needle changes that will result, material handling requirements, customer, designated ship dates, etc. Each such change is associated with a cost factor such as, for example, a time value that represents the amount of machine downtime involved, or for example a material waste factor. In the default sort order, the highest sort fields are the priority and delivery deadlines. Next, the sort is by default machine. Next, the sort is by needle setting, which may involve a time of from 30 to 45 minutes. Next, the sort is by material types, preferably top goods first, then first fill, then second fill, then last fill, then backing material. Material changes usually take less than five minutes, but location of the different materials about the facility is a factor to be considered, where practical. Next, the sort is by pattern. Patterns are changed automatically, so time is not a factor. Pattern changes often produce a strip of waste material. Sometimes panel width is considered, particularly where the facility gives priority to the stacking and handling of finished products. The sort order can be changed, and often differs from facility to facility. In generating the automated scheduling, different combinations and orders of product are tested and the cost factors totaled. The schedule with the lowest cost factor that meets all required criteria is deemed optimum.

Upon completion of the sort and generation of proposed optimum schedules, the results are displayed to the user for not only the automated and computerized machines but also manual machines in the facility. The user is particularly alerted to overloads and other issues that would prevent successful completion of the run. The generation of the optimum schedule is intentionally caused to force near maximum capacity of machines, allowing the scheduling of machine overloads. This gives the user the ability to manually adjust the schedules to make compromises in a way that is most likely to result in the most efficient use of the facility. The redistribution of jobs among the machines can be carried out by manually editing the schedule, or by allowing the autoschedule computer 51 to automatically Load Balance. Load Balancing performed automatically by the computer or performed by the user is carried out by taking jobs from each overloaded machine that are sufficient to eliminate the overload, giving priority to job groupings based on the highest sort order. For example, moving all jobs using particular Top Goods from one machine to another, or all jobs using a particular needle setting. In automatic load balancing, the same optimization logic as employed in the initial sort may be used, with overloads of machines deemed not permitted. The system thereby seeks to minimize the cost factor without allowing machine overloads.

Once all changes are made, if any, and as long as the schedule is suitable particularly for the operations for the next day, shift and hour, the schedules are submitted to the quilting machines.

The Production menu, illustrated in FIG. 3F, provides the ability to load production data from the individual machines 10 to the autoschedule system 50 using the window illustrated in FIG. 41 by selection of the Get_Production item from the menu, and to produce production reports using the window illustrated in FIG. 4J by selection of the Production_Report item from the menu. When these functions are completed, the screen illustrated FIG. 4K is presented to allow for the updating of inventory based on the materials used during the production of the orders listed in the report.

From the above description of the preferred embodiments of the invention, it will be apparent to those skilled in the art that changes and additions to the method and apparatus can be made without departing from the principles of the present invention. Accordingly, the following is claimed:

What is claimed is:

1. A quilt manufacturing system comprising:

a plurality of quilting machines, each having a programmed controller operative to control the machines to produce quilted products on multi-layered material in accordance with product configuration data;

a scheduling sub-system having communication links to each of the quilting machines;

a customer order input station for receiving customer order data identifying quilted products to be manufactured for customers;

digital storage media connected to the scheduling sub-system containing:

data identifying each of the quilting machines and certain of their features that affect details of quilted products identified in the customer order data and made by the respective machines, data identifying material from which quilted products identified in the customer order data are made, and data of details of each respective product identified in the customer order data, which details specify materials of which the products are made and pattern and other machine parameter data required by a quilting machine to make the respective product; and the scheduling sub-system including a digital processor programmed to generate schedules for each of the machines and to download schedules to controllers of each of the machines to cause the production of quilted products identified in the customer data, the processor being programmed to evaluate the material identifying data, the product details data and the machine identifying and feature data, and to determine the content of the generated schedules based on the evaluation.

2. The apparatus of claim 1 wherein:

the programmed processor includes program means for optimizing the distribution of work among the machines.

3. The apparatus of claim 1 further comprising:

the programmed processor includes program means for optimizing the distribution of work among the machines so as to reduce the time that the machines are not producing products.

4. The apparatus of claim 1 further comprising:

the programmed processor includes program means for optimizing the distribution of work among the machines so as to reduce the time required of human operators to operate the machines to produce the products.

5. The apparatus of claim 1 wherein:

the programmed processor includes program means for optimizing the timely production and production costs of the products.

6. The apparatus of claim 1 wherein:

the programmed processor includes program means for recording the history of the production of products on each machine when producing products according to the automatically generated schedules and generating future schedules based on the recorded history.

7. The apparatus of claim 1 wherein:

the controllers of each of the machines are operable to communicate information to the scheduling sub-system regarding events including stoppages of the respective machines;

the programmed processor includes program means for producing reports of the communicated information.

8. The apparatus of claim 1 wherein:

the controllers of each of the machines are operable to communicate information to the scheduling sub-system regarding events including stoppages of the respective machines;

the programmed processor includes program means for generating future schedules based on the communicated information.

9. The apparatus of claim 1 wherein:

a plurality of the quilting machines are multi-needle quilting machines that simultaneously quilt pluralities of patterns onto multi-layered fabric webs in accordance with the settings of needles and in accordance with stored data files containing machine control information for quilting various patterns.

10. A method of manufacturing quilts at a quilting facility having a plurality of quilting machines each controlled by programmed controllers, the method comprising the steps of:

maintaining machine data records identifying each of the machines of the plurality;

maintaining material data records cataloging materials from which quilts are produced on the machines;

maintaining product data records specifying details of quilted products to be made on the machines from the materials, inputting to a central computer a plurality of customer orders each requesting one or more products for production on the machines;

evaluating at the central computer the product data records related to products requested by the customer orders and, based on product detail data in the product data records, producing optimized schedules for each of a plurality of the machines in accordance with material data, machine data and product data;

downloading to each of the machines of the plurality optimized schedules for the production of quilted products thereon based on product, material and machine information; and quilting the products on each of the machines in accordance with the downloaded schedules and maintained data related thereto.

11. The method of claim 10 wherein the evaluating step includes the step of:

optimizing the distribution of work among the machines so as to reduce the time that the machines are not producing products.

12. The method of claim 10 wherein the evaluating step includes the step of:

optimizing the distribution of work among the machines so as to reduce the time required of human operators to operate the machines to produce the products.

13. The method of claim 10 wherein the evaluating step includes the step of:

optimizing the timely production and production costs of the products.

14. The method of claim 10 wherein the evaluating step includes the step of:

recording the history of the production of products on each machine when producing products according to the automatically generated schedules and generating future schedules based on the recorded history.

15. The method of claim 10 further comprising the steps of:

communicating information to the scheduling sub-system regarding events including stoppages of the respective machines; and producing reports of the communicated information.

16. The method of claim 10 further comprising the steps of:

communicating information from the machines to the scheduling sub-system regarding events including stoppages of the respective machines; and generating schedules based on the communicated information.

17. A automatically scheduleable quilt manufacturing system comprising a plurality of quilting machines and a central computer linked to each of the machines and programmed according to the method of claim 10.

18. A method of manufacturing quilts at a quilting facility having a plurality of quilting machines, each controlled by programmed controllers, the method comprising the steps of:

maintaining machine data records identifying each of the machines of the plurality;

maintaining material data records cataloging materials from which quilts are produced on the machines;

maintaining product data records specifying quilted products to be made on the machines from the materials and including material, size, and pattern, maintaining pattern data records in controllers at each of the machines having data therein effective to cause the operation of the machine to quilt a respectively defined pattern on a quilted product, inputting to a central computer a plurality of customer orders each requesting one or more products for production on the machines;

evaluating at the central computer the product data records related to products requested by the customer orders and, based on data in the product data records, producing optimized schedules for each of a plurality of the machines in accordance with material data, machine data and pattern and other product data;

downloading to each of the machines of the plurality optimized schedules for the production of quilted products thereon based on product, material and machine information; and quilting the products on each of the machines in accordance with the downloaded schedules and maintained data related thereto.

19. The method of claim 18 further comprising the steps of:

downloading updated pattern files from the scheduling system to controllers of the quilting machines.

* * * * *

UNITED STATES PATENT AND TRADEMARK OFFICE

CERTIFICATE OF CORRECTION

PATENT NO. : 6,105,520
DATED : August 22, 2000
INVENTOR(S) : Frazer et al.

It is certified that error appears in the above-identified patent and that said Letters Patent is hereby corrected as shown below:

Column 5,
Line 33, delete "2300e", and insert therefor -- 2300e+ --.

Column 8,
Line 33, delete "scheduling operator intervention", and insert therefor -- scheduling operator or machine operator intervention --.

Column 9,
Line 46, delete "Machine Top Speed,", and insert therefor
-- Machine_Top_Speed --.
Line 47, delete "Machine_Carriage Travel", and insert therefor --
Machine_Carriage_Travel --.

Column 10,
Line 33, delete "Job Type,", insert therefor -- Job_Type --.

Column 13,
Line 1, in the heading, delete the heading "Commands Sent from Scheduling Computer 50 to Quilting Machines 10:".
Line 20, delete "SET PONR. TXT", and insert therefor -- SET_PONR.TXT --.

Column 16,
Line 60, delete "FIG. 41", and insert therefor -- FIG. 4I --.

Signed and Sealed this

Twenty-fifth Day of December, 2001

*Attest:*

*Attesting Officer*

JAMES E. ROGAN
*Director of the United States Patent and Trademark Office*